US006904255B2

(12) United States Patent
Kera et al.

(10) Patent No.: US 6,904,255 B2
(45) Date of Patent: Jun. 7, 2005

(54) COLOR IMAGE FORMING METHOD AND COLOR IMAGE FORMING DEVICE

(75) Inventors: Hiroshi Kera, Kawasaki (JP); Atsushi Tano, Kawasaki (JP); Hiroki Ohta, Kawasaki (JP); Tsuneo Mizuno, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/479,119

(22) PCT Filed: May 31, 2001

(86) PCT No.: PCT/JP01/04589

§ 371 (c)(1),
(2), (4) Date: Mar. 19, 2004

(87) PCT Pub. No.: WO02/099536

PCT Pub. Date: Dec. 12, 2002

(65) Prior Publication Data

US 2004/0136758 A1 Jul. 15, 2004

(51) Int. Cl.[7] ..... G03G 15/01; G03G 15/08
(52) U.S. Cl. ..... 399/299; 399/53; 399/302
(58) Field of Search ..... 399/53, 55, 223, 399/226, 227, 298, 299, 302

(56) References Cited

U.S. PATENT DOCUMENTS

| | | | | |
|---|---|---|---|---|
| 5,363,178 A | * | 11/1994 | Matsumoto | 399/299 |
| 5,600,421 A | * | 2/1997 | Takekoshi et al. | 399/299 X |
| 5,627,629 A | | 5/1997 | Takahashi et al. | |
| 5,978,615 A | | 11/1999 | Tanaka et al. | |
| 6,134,395 A | * | 10/2000 | Sasaki et al. | 399/53 X |
| 6,281,324 B1 | | 8/2001 | Nakamura et al. | |
| 6,389,260 B1 | * | 5/2002 | Kataoka et al. | 399/298 |

FOREIGN PATENT DOCUMENTS

| | | |
|---|---|---|
| JP | A 62-153873 | 7/1987 |
| JP | B2 1-32981 | 7/1989 |
| JP | A 7-146597 | 6/1995 |
| JP | A 9-34269 | 2/1997 |
| JP | A 9-319179 | 12/1997 |
| JP | A 10-171241 | 6/1998 |
| JP | A 10-228188 | 8/1998 |
| JP | A 2000-187403 | 12/1998 |
| JP | A 11-327222 | 11/1999 |
| JP | A 2000-147864 | 5/2000 |
| JP | A 2000-147920 | 5/2000 |
| JP | A 2001-92212 | 4/2001 |
| JP | A 2001-117334 | 4/2001 |

* cited by examiner

*Primary Examiner*—Sandra L. Brase
(74) *Attorney, Agent, or Firm*—Oliff & Berridge, PLC

(57) ABSTRACT

The present invention relates to a color image forming device for forming toner images of a plurality of colors on a medium, and is for improving second transfer efficiency from an intermediate transfer body to the medium. The device has image forming units (12-1 to 12-4) for forming the toner images of the plurality of colors on at least one image bearing body (14-1 to 14-4) by a plurality of developing units (22-1 to 22-4) respectively accommodating toner of different colors; an intermediate transfer body (24); primary transfer means (38-1 to 38-4) for primary transferring the toner images of the plurality of colors onto the intermediate transfer body sequentially for the respective colors; and secondary transfer means (45) for secondary transferring the toner images of the plurality of colors on the intermediate transfer body onto the medium. The image forming units form the toner images of the plurality of colors so that the potentials of toner layers transferred onto the intermediate transfer body (24) are progressively lower in the order in which the plurality of colors are transferred. Since the potential of the toner layer directly adhered to the intermediate transfer body is higher, the directly adhered toner layer becomes easier to be secondary-transferred, and thereby, the secondary transfer efficiency is improved and the reproducibility of the secondary color is improved.

20 Claims, 13 Drawing Sheets

COLOR IMAGE FORMING METHOD AND COLOR IMAGE FORMING DEVICE

TECHNICAL FIELD

The present invention relates to a color image forming method and a color image forming device for forming a color image by electrophotography process, and specifically, to a color image forming method and a color image forming device with an intermediate transfer process in which toner images of a plurality of colors are transferred to an intermediate transfer body and superposed thereon, and then, finally transferred onto an output medium.

BACKGROUND ART

With recent development of the color image processing technology, a device for outputting a color image is utilized. Specifically, an image forming device such as a printer for forming a color image on a sheet by using an electrophotography process is utilized. For this color image forming device, there are methods for forming toner images of respective colors directly on a sheet, and for forming toner images of respective colors on an intermediate transfer body and then, transferring the toner images on the intermediate transfer body onto a sheet. The latter is suitable for high speed printing because sheets can be easily fed.

Color image forming devices using such an intermediate transfer body are divided roughly into two types of four-pass type and single-pass type (tandem type). These color image forming devices are disclosed in Japanese Patent Application Laid-Open (JP-A) Nos. 9-34269, 10-228188, 2000-147920, 2000-187403, and the like.

By referring to FIGS. 21 and 22, a conventional intermediate transfer body type color image forming method will be described with an example of a single-pass type device. As shown in FIG. 21, image forming units 112-1 to 112-3 are provided for respective colors of yellow (Y), magenta (M), and cyan (C). Note that a black (K) image forming unit is also provided, but omitted for simplicity of description. These image forming units 112-1 to 112-3 have photosensitive drums, and are constituted by disposing cleaning blades, charging units, LED exposure units, and developing units that surround the drums.

In the image forming units 112-1 to 112-3, toner images of the respective colors are formed on the photosensitive drums by a known electrophotography process. The toner images of the respective colors on the photosensitive drums are electrostatically transferred onto a moving intermediate transfer belt 116 in a sequentially superposed manner by applying transfer voltages (referred to as "primary transfer") Next, the toner image on the intermediate transfer belt 116 is transferred onto an output sheet 120 by a secondary transfer unit (referred to as "secondary transfer"). The toner image on the sheet 12 is fixed by a fixing unit and outputted.

That is, at the time of the primary transfer, onto this intermediate transfer belt 116, a yellow (Y) toner image 130 is transferred, then, a magenta (M) toner image 132 is transferred, and finally, a cyan (C) toner image 134 is transferred. In the cases of a primary color, a secondary color, and a tertiary color, a toner image of one of the three colors, toner images of two of the three colors, and toner images of all of the three colors are transferred, respectively.

Then, this primary transferred image on the intermediate transfer body 116 is transferred onto the medium 120 at one time. The transfer efficiency at this secondary transfer part is, in the case of a primary color, hardly problematic regardless of the charge amount of toner because the deposit amount of the toner is small.

However, in the case of a secondary color, since toner whose amount is twice that of the primary color on the intermediate transfer body, the deposit amount on the intermediate transfer body increases and the secondary transfer efficiency becomes lower. For example, if the deposit amount of the toner becomes doubled with the charge amount thereof kept constant, the toner layer potential becomes quadrupled because the toner layer potential is proportional to the square of the thickness of the toner layer. Basically, in the transfer operation, if a potential having reverse polarity to the potential Vt of the toner layer is applied, the theoretical transfer efficiency becomes 100%. For this purpose, the transfer voltage may be increased, however, since the influence of discharge is exerted, the upper limit will be restricted.

Therefore, when the transfer voltage equal to or less than the upper limit is used, the toner 130 which directly contacts with the belt 116 of the toner images of the secondary color on the belt 116 becomes hard to be transferred. That is, the toner 130 which directly contacts with the belt 116 is strongly adhered to the belt 116, and the toner 132 thereon is weakly adhered to the belt 116.

As shown in FIG. 22, conventionally, since the charge amounts of the toner 130, 132, and 134 of the respective colors are set equal, when the two colors are superposed, the superposition is performed with the toner layer potential and the deposit amount at the same rate. On this account, for example, applying the transfer field with secondary transfer efficiency of 75% is applied, 75% of the toner in the upper toner layer of two colors is secondary transferred.

Thus, the secondary transfer efficiency is difficult to be improved, and a problem arises that the ratio of toner of two colors is varied. Various proposals are made for uniforming the primary transfer efficiency, which is different from the secondary transfer efficiency, among the respective colors. For example, in Japanese Patent Publication (JP-B) No. 1-32981, a method for increasing the charge amounts of the respective colors from the upstream side of the belt toward the downstream side is proposed, and in Japanese Patent Application Laid-Open (JP-A) No. 7-146597, a method for regulating the surface potential, the charge amount of toner, and the thickness of the toner layer before transfer on the most downstream side is proposed.

However, these are methods for uniforming the primary transfer efficiency and the secondary transfer efficiency is not considered. For example, at the time of the primary transfer, since, by the charge of the toner formed on the upstream side on the intermediate transfer body, the primary transfer field is weaken when the next color is transferred, and the transfer efficiency of the next color becomes lower, the proposal is made to make the charge amount of the toner lower toward the upstream side of the intermediate transfer body.

However, by this method, though the primary transfer efficiency becomes uniform for the respective colors, in the secondary transfer, since the lower a layer is on the intermediate transfer body, the smaller a charge amount of the toner thereof is, a problem arises in that the toner in the lower layer becomes more difficult to be secondary transferred.

DISCLOSURE OF THE INVENTION

Therefore, an object of the present invention is to provide a color image forming method and a color image forming device for improving secondary transfer efficiency of a secondary color.

Further, another object of the invention is to provide a color image forming method and a color image forming device for improving the secondary transfer efficiency even if a secondary transfer voltage is reduced.

Furthermore, still another object of the invention is to provide a color image forming method and a color image forming device for improving the secondary transfer efficiency and reproducing the secondary color precisely.

In order to achieve these objects, a color image forming method of the invention includes the steps of: forming the toner images of the plurality of colors on at least one image bearing body by a plurality of developing units respectively accommodating toner of different colors; primary transferring the toner images of the plurality of colors onto an intermediate transfer body sequentially for respective colors; and secondary transferring the toner images of the plurality of colors on the intermediate transfer body onto the medium. Wherein the toner image forming step includes a step of forming the toner images of the respective colors so that potentials of toner layers transferred onto the intermediate transfer body are progressively lower in the order in which the plurality of colors are transferred.

In the invention, superposition is performed so that, of the toner layers of the secondary color (two layers) on the intermediate transfer body, the potential of the toner layer directly adhered to the transfer body is made higher, and the potential of the upper toner layer deposited by the superposition is made lower. Since the potential of the toner layer directly adhered to the intermediate transfer body is higher, the directly adhered toner layer becomes easier to be secondary-transferred, and the secondary transfer efficiency can be improved with the secondary transfer voltage equal to that in the conventional case.

Further, in the invention, it is preferred that a step of forming the toner images of the respective colors is included so that the charge amounts of the toner images of the respective colors are progressively lower in the order in which the plurality of colors are transferred. Thereby, under the control of charge amounts, the secondary transfer efficiency can be easily improved.

Furthermore, in the invention, it is preferred that the toner image forming step includes a step of forming the toner images of the respective colors so that the charge amounts of the toner images of the respective colors are progressively lower in the order in which the plurality of colors are transferred, by varying electrical development conditions of the developing units of the respective colors. Thereby, the secondary transfer efficiency can be easily improved without drastic changes in the mechanism and the process conditions.

Moreover, in the invention, it is preferred that the toner image forming step includes a step of forming the toner images of the respective colors so that the charge amounts of the toner images of the respective colors are progressively lower in the order in which the plurality of colors are transferred, by varying blade bias voltages supplied to blades for restricting toner layer thicknesses on developing rollers of the developing units. Thereby, the secondary transfer efficiency can be easily improved with few changes in the mechanism and the process conditions.

In addition, in the invention, it is preferred that the toner image forming step includes a step of forming the toner images of the respective colors so that the charge amounts of the toner images of the respective colors are progressively lower in the order in which the plurality of colors are transferred, by varying reset bias voltages supplied to reset rollers for supplying toner to developing rollers of the developing units. Thereby, the secondary transfer efficiency can be easily improved with few changes in the mechanism and the process conditions.

Further, in the invention, it is preferred that the toner image forming step includes a step of forming the toner images of the respective colors so that the deposit amounts of the toner transferred onto the intermediate transfer body are progressively lower in the order in which the plurality of colors are transferred. Thereby, even if the reverse transfer occurs in the respective transfer processes, the deposit amounts of the toner of the respective colors before the secondary transfer can be made uniform, which contributes to high quality color image formation.

Furthermore, in the invention, it is preferred that the toner image forming step includes a step of forming the toner images of the respective colors so that the deposit amounts of the toner images of the respective colors are progressively lower in the order in which the plurality of colors are transferred, by varying electrical development conditions of the developing units of the respective colors. Thereby, the deposit amounts before the secondary transfer can be easily made uniform without drastic changes in the mechanism and the process conditions.

Moreover, in the invention, it is preferred that the toner image forming step includes a step of forming the toner images of the respective colors so that the deposit amounts of the toner images of the respective colors are progressively lower in the order in which the plurality of colors are transferred, by varying blade bias voltages supplied to blades for restricting toner layer thicknesses on developing rollers of the developing units. Thereby, the deposit amounts before the secondary transfer can be easily made uniform with few changes in the mechanism and the process conditions.

In addition, in the invention, it is preferred that the toner image forming step includes a step of forming the toner images of the respective colors so that the deposit amounts of the toner images of the respective colors are progressively lower in the order in which the plurality of colors are transferred, by varying reset bias voltages supplied to reset rollers for supplying toner to developing rollers of the developing units. Thereby, the deposit amounts before the secondary transfer can be easily made uniform with few changes in the mechanism and the process conditions.

Further, in the invention, it is preferred that the toner image forming step includes a step of forming the toner images of the respective colors so that the deposit amounts of the toner images of the respective colors are progressively lower in the order in which the plurality of colors are transferred, by varying developing bias voltages supplied to developing rollers of the developing units. Thereby, the deposit amounts before the secondary transfer can be easily made uniform with few changes in the mechanism and the process conditions.

Furthermore, in the invention, it is preferred that the toner image forming step includes a step of forming the toner images of the respective colors of the plurality of colors by the plurality of developing units accommodating toner of corresponding colors, on a plurality of image bearing bodies respectively corresponding to the plurality of colors.

BEST MODE FOR CARRYING OUT THE INVENTION

Hereinafter, embodiments of the present invention will be described in the order of a color image forming device, a first color image forming method, a second color image forming method, and other embodiments.

[Color Image Forming Device]

Figure 1:
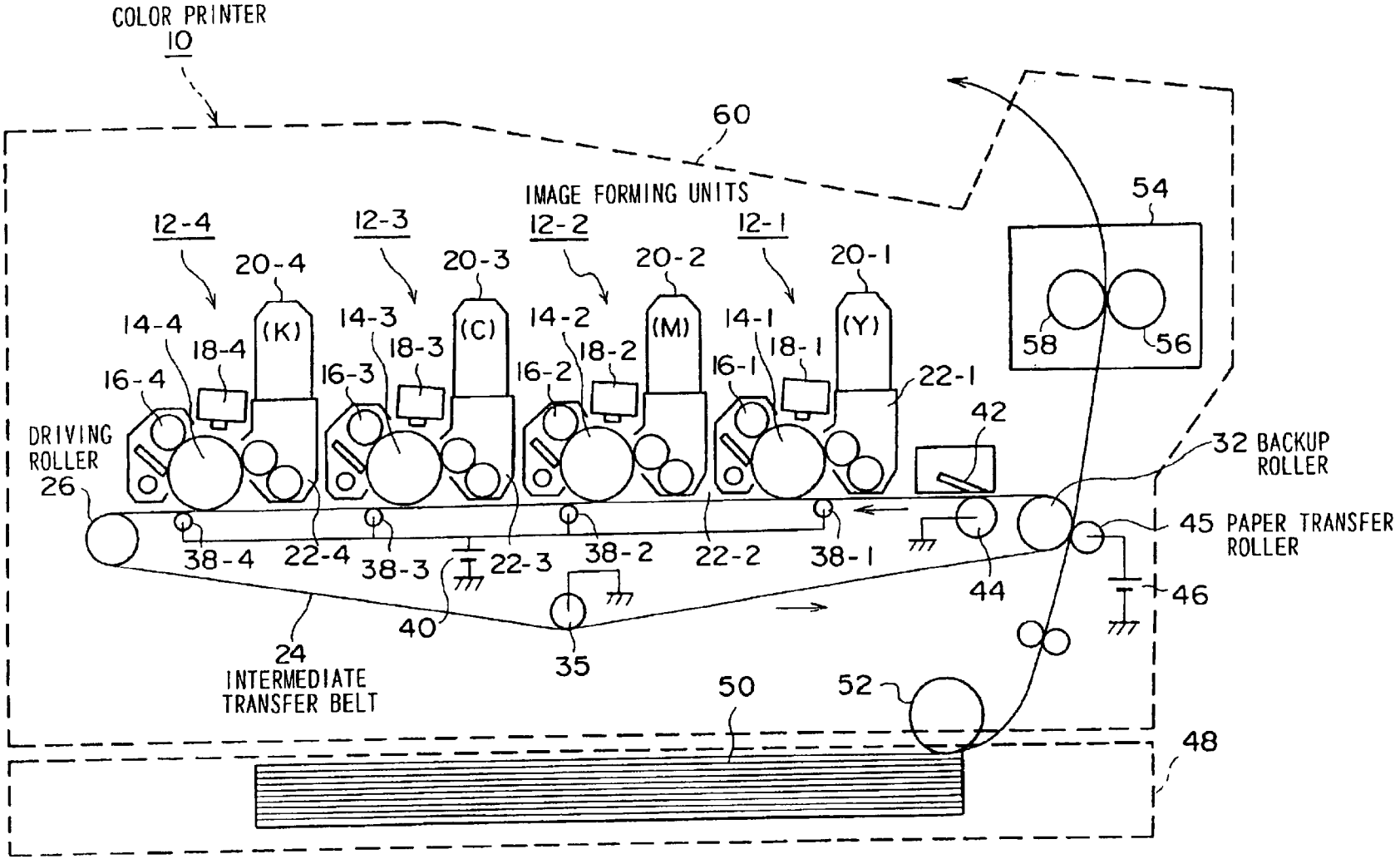
FIG. 1 is a structural view of an image forming device of one embodiment of the present invention.
Figure 2:
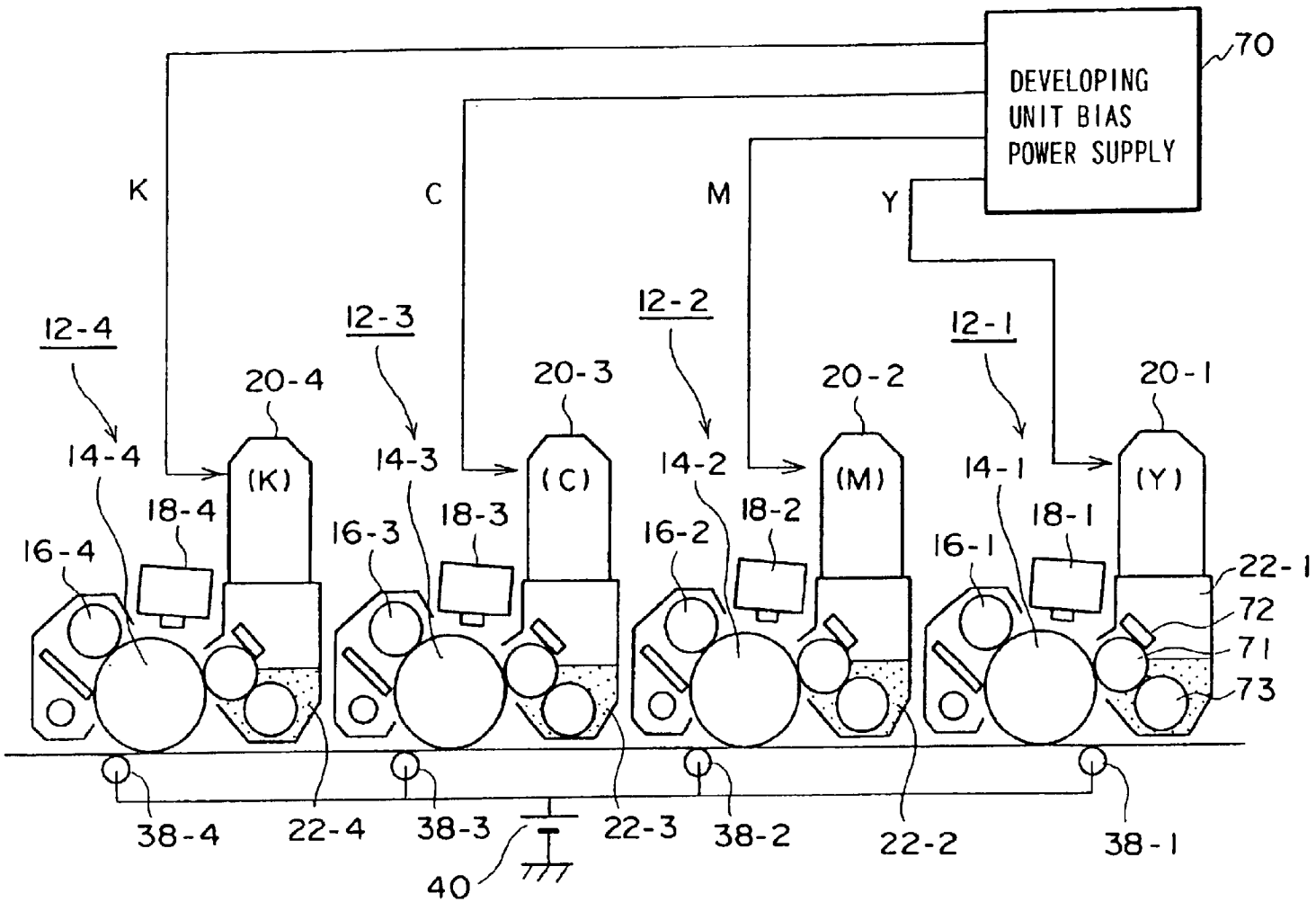
FIG. 2 is a structural view of a main part of FIG. 1.

FIG. 1 is a structural diagram of a color image forming device of one embodiment of the invention, and FIG. 2 is a structural diagram of a main part of FIG. 1.

FIG. 1 shows a device structure of a color page printer of single-pass (tandem) type as a color image forming device. In a color printer 10, an intermediate transfer belt 24 used as an intermediate transfer member is disposed. The intermediate transfer belt 24 is wrapped around a driving roller 26, a tension roller 35, a backup roller 32 serving as a driven roller. The intermediate transfer belt 24 rotates counterclockwise in the figure with the rotation of the driving roller 26 by a motor which is not shown.

Above the intermediate transfer belt 24, image forming units 12-1, 12-2, 12-3, and 12-4 are disposed from the upstream side (right side) toward the downstream side (left side) in the order of yellow (Y), magenta (M), cyan (C), and black (K). In the image forming units 12-1 to 12-4, photosensitive drums 14-1, 14-2, 14-3, and 14-4 as image bearing bodies are provided.

Around the photosensitive drums 14-1 to 14-4, chargers 16-1 to 16-4, LED arrays 18-1 to 18-4, developing units 22-1 to 22-4 with toner cartridges 20-1 to 20-4 are disposed. Further, cleaning blades, static eliminators, etc., are disposed in front of the chargers 16-1 to 16-4.

The photosensitive drums 14-1 to 14-4 provided in the image forming units 12-1 to 12-4 contact the intermediate transfer belt 24 on the lower ends thereof. Intermediate transfer rollers 38-1, 38-2, 38-3, and 38-4 used as intermediate transfer electrode members to which primary transfer voltage is applied are disposed on the opposite position to the belt contact points relative to the intermediate transfer belt 24.

In this embodiment, the intermediate transfer rollers 38-1 to 38-4 are disposed in contact with the intermediate transfer belt and are spaced away from the contact points between the photosensitive drums 14-1 to 14-4 and the intermediate transfer belt 24, i.e., so called transfer nips, in the direction of the belt surface. As shown also in FIG. 2, in the embodiment, the intermediate transfer rollers 38-1 to 38-4 are separately disposed toward the downstream side of the belt relative to the transfer nips as belt contact points of the photosensitive drums 14-1 to 14-4, respectively.

To these intermediate transfer rollers 38-1 to 38-4, predetermined voltages which has been independently set within the range from +500 V to +1000 V from a power supply 40 are applied at the timing of primary transfer.

Against the backup roller 32 provided on the upstream side of the intermediate transfer belt 24 which is the opposite side thereof from the driving roller 26, a paper transfer (secondary transfer) roller 45 for applying a secondary voltage is disposed with the intermediate transfer belt 24 therebetween. A constant current power supply 46 is connected to the paper transfer roller 45, and applies a prescribed bias voltage at the timing of secondary transfer.

Thereby, a toner image formed by being superposed on the intermediate transfer belt 24 is transferred onto a sheet 50 fed from a hopper 48 by a pickup roller 52. The sheet to which the image has been transferred by the paper transfer roller 45 is heated and fixed by a fixing unit 54, and then, discharged to a stacker 60. A heat roller 56 and a backup roller 58 are provided in the fixing unit 54.

Additionally, a cleaning blade 42 is disposed between the backup roller 32 on the upstream side of the intermediate transfer belt 24 and the first image forming unit 12-1 using yellow toner, and an earth roller 44 is disposed opposite to this cleaning blade 42 with the intermediate transfer belt 24 therebetween.

The earth roller 44 is an electrically ground connected roller. The tension roller 35 disposed between the driving roller 26 and the backup roller 32 applies prescribed tensile force to the intermediate transfer belt 24, and the tension roller 35 is also electrically ground connected. Contrary to the electrical ground connections of the earth roller 44 and the tension roller 35, the driving roller 26 and the backup roller 32 are placed in an electrically floating state.

Further, details of respective parts of the color printer 10 will be described. The photosensitive drums 14-1 to 14-4 provided in the image forming units 12-1 to 12-4 are formed, for example, by coating an aluminum base tube having an outer diameter of 30 mm with a photosensitive layer having a layer thickness of about 25 μm composed of a charge generation layer and a charge transport layer. When forming an image, drum surfaces are uniformly charged by the chargers 16-1 to 16-4.

As the chargers 16-1 to 16-4, conductive brushes are used. The brushes are allowed to contact the surfaces of the photosensitive drums 14-1 to 14-4 and apply a charging bias, for example, with a frequency of 800 Hz, a P-P voltage of 1100 V, and an offset voltage of −650 V, to charge the photosensitive drum surfaces of about −650 V. As the charging process, other than this, corona chargers, solid roller chargers, and the like can be used.

After the charging of the photosensitive drums 14-1 to 14-4 is completed, using the subsequently disposed LED arrays 18-1 to 18-4, exposures in response to the respective images are performed to form electrostatic latent images on the photosensitive drum surfaces. By the way, in place of the LED arrays 18-1 to 18-4, a laser scanning exposure device can be used.

After the formation of the electrostatic latent images on the photosensitive bodies of the photosensitive drums 14-1 to 14-4, development is performed using toner of respective colors by the developing units 22-1 to 22-4 to make the electrostatic latent image into a visualized image. In this embodiment, as a developing method, a non-magnetic one-component contact development using negatively charged non-magnetic one-component toner is utilized. As a matter of course, the developing method is not limited to the non-magnetic one-component contact development. Further, the polarity of toner charge is not limited to negative.

Next, after the toner images of the respective colors are formed on the photosensitive drums 14-1 to 14-4 by the image forming units 12-1 to 12-4, the primary transfer is performed onto the intermediate transfer belt 24. The respective monochromatic images of yellow, magenta, cyan, and black formed by the image forming units 12-1 to 12-4 are sequentially transferred onto the intermediate transfer belt 24, and the images of the respective colors are superposed to form a color image.

As for the timing in superposing the toner images of the respective colors, by adjusting the start timing in writing by the LED arrays 18-1 to 18-4, the toner images of the respective colors are accurately aligned. The transfer from the photosensitive drums 14-1 to 14-4 to the intermediate transfer belt 24 is electrostatically performed by applying predetermined primary transfer voltages determined within a range from +500 V to +1000 V to the intermediate transfer rollers 38-1 to 38-4.

Here, the intermediate transfer belt 24 is a polycarbonate resin member having a thickness of 150 μm and resistance-adjusted by carbon, and its resistance value is, which will be described later, defined within a predetermined range so that the volume resistivity in the thickness direction of the belt and the surface resistivity of the belt surface enable the primary transfer to be performed efficiently.

Furthermore, the applied voltages to the intermediate transfer rollers 38-1 to 38-4 are adjusted by the resistance value of the intermediate transfer belt 24, which is determined by the spaced distances between the intermediate transfer rollers 38-1 to 38-4 and the transfer nips as the belt contact points of the photosensitive drums 14-1 to 14-4. The material of the intermediate transfer belt 24 is not limited to the polycarbonate resin, but also resin materials such as polyimide, nylon, and fluorine can be used.

Next, the details of the secondary transfer will be described. The color image formed on the intermediate transfer belt 24 is transferred onto, for example, the sheet 50 as a recording medium at a time by the secondary transfer using the paper transfer roller 45. As the paper transfer roller 45 serving as the secondary transfer roller, a sponge roller in which the resistance value between the center axis and the roller surface is adjusted on the order of 1E+5 to 1E+8 Ω is used, and is disposed so as to be pressed against the backup roller 32 with pressure of about 0.5 to 3 kg with the intermediate transfer belt 24 therebetween.

The hardness of the sponge roller 45 is made to be from 40 to 60 degrees in Asker C scale. In the secondary transfer, the color image on the intermediate transfer belt 24 is electrostatically transferred onto the sheet 50 fed and carried by the pickup roller 52 in exact timing with the image position on the intermediate transfer belt 24, by applying the prescribed bias voltage by the constant current power supply 46 to the paper transfer roller 45.

The color image transferred onto the sheet 50 is passed through the fixing unit 54 constituted by a heat roller 56 and a backup roller 58 to obtain a fixed image by fixing the developer thermally onto the sheet 50, and then, discharged to the stacker 60.

The printing speed in the series of color printing process in such a color printer 10, i.e., the feeding speed determined by the speed of the intermediate transfer belt 24 is 91 mm/s, for example. As a matter of course, the feeding speed of the sheet is not limited to this, and a similar result is obtained at the half speed, 45 mm/s. The printing speed is not limited to this, and a similar result is obtained at a faster speed.

It is desirable that the transfer voltages of the respective colors used for the primary transfer have the same voltage characteristics with which similar transfer efficiency can be obtained. In the embodiment in FIGS. 1 and 2, since the intermediate transfer rollers 38-1 to 38-4 of the respective colors are disposed in the similar positions on the downstream side of the transfer nips of the photosensitive drums 14-1 to 14-4, the voltage characteristics of the transfer efficiency of the respective colors show substantially the same tendency. Essentially, it is sufficient that variations in effective voltages at the parts of the transfer nips of the respective colors lie within the voltage margins of the transfer efficiency, and that the voltage margins of the respective colors overlap.

Next, the electrical separate structure of the primary transfer part and the secondary transfer part in the intermediate transfer belt 24 in the color printer 10 in FIG. 1 will be described. First, the intermediate transfer belt 24 as a resistive element has a structure tensed by the driving roller 26 and the backup roller 32, and the driving roller 26 and the backup roller 32 are in an electrically floating state.

On this account, the current flowing into the intermediate transfer rollers 38-1 to 38-4 when the primary transfer voltages are applied by the power supply 40 is prevented from leaking out of the driving roller 26 and the backup roller 32, and thereby, the leakage current is reduced to prevent the wasted current consumption.

Additionally, since intermediate transfer rollers 38-1 to 38-4 and the paper transfer roller 45 for the secondary transfer are in contact with the intermediate transfer belt 24, the timing in applying the secondary transfer voltage by the paper transfer roller 45 sometimes overlaps the timing in applying the primary transfer voltages.

Therefore, the earth roller 44 that is electrically ground connected is disposed between the paper transfer roller 45 to which the secondary transfer voltage is applied and the intermediate transfer roller 38-1 located on the most upstream side to which the primary transfer voltage is applied, and the tension roller 35 between the driving roller 26 and the backup roller 32 is electrically ground connected.

Thereby, the belt region applied with the primary transfer voltages of the intermediate transfer rollers 38-1 to 38-4 and the belt region applied with the secondary transfer voltage by the paper transfer roller 45 of the intermediate transfer belt 24 are electrically separated, and the electrical influence of the primary transfer voltages and the secondary transfer voltage is suppressed.

Figure 3:
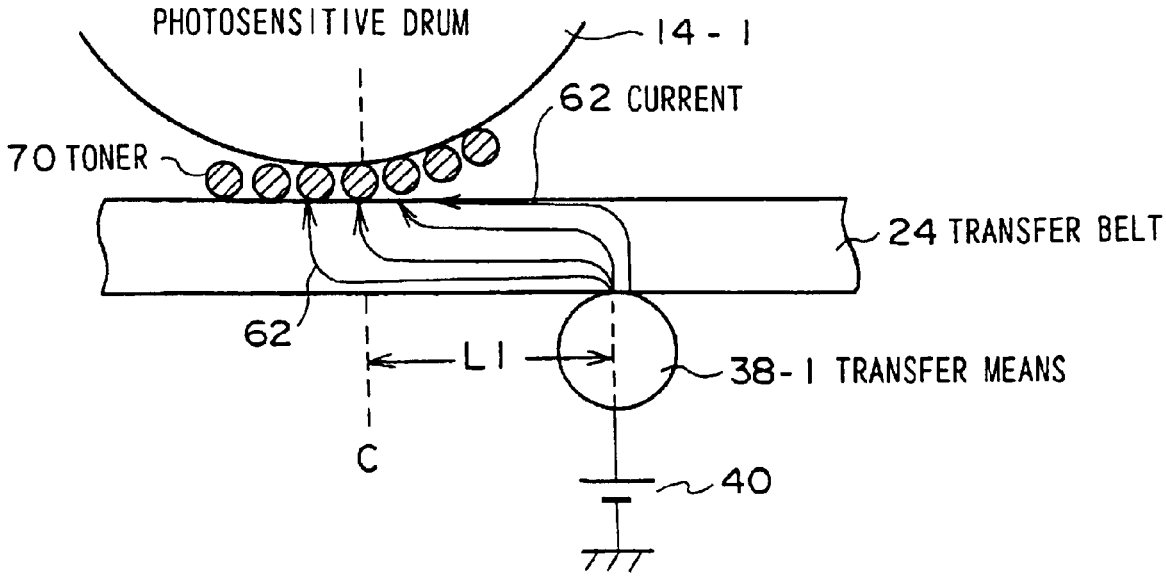
FIG. 3 is an explanatory view of a primary transfer method utilizing resistance along the surface direction, which is applied to the device in FIG. 1.
Figure 4:
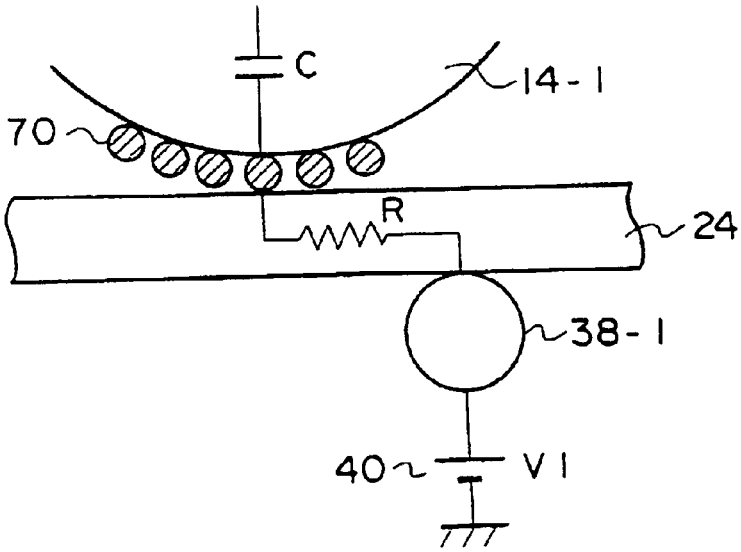
FIG. 4 is a diagram of an equivalent circuit of the transfer method in FIG. 3.

Next, the primary transfer and the intermediate transfer body in the color printer 10 in FIG. 1 will be described in detail. FIG. 3 is an explanatory diagram of the primary transfer, and FIG. 4 is a diagram of an equivalent circuit thereof.

In FIG. 3, the intermediate transfer rollers 38-1 to 38-4 serving as primary transfer rollers are made of stainless, and, for example, rotatable metal rollers having outer diameters of 8 mm are used. FIG. 3 shows the arrangement relationship relative to the intermediate transfer belt 24, by taken out the photosensitive drum 14-1 provided in the image forming unit 12-1 located on the most upstream side in FIG. 1 and the intermediate transfer roller 38-1 provided corresponding thereto.

Note that, for convenience of description, the figure in which the intermediate transfer roller 38-1 is disposed on the upstream side of the photosensitive drum 14-1 is shown, however, the same effect is obtained in the case where the intermediate transfer roller 38-1 is disposed on the downstream side of the photosensitive drum 14-1 as shown in FIG. 1.

In FIG. 3, the distance L1 between the center line C that is extended vertically downward from the center of the photosensitive drum 14-1 and the center line that is similarly extended vertically downward from the center of the intermediate transfer roller 38-1 is set, for example, as L1=10 mm, and the intermediate transfer roller 38-1 is disposed on the upstream side along the belt moving direction relative to the portion where the photosensitive drum 14-1 contacts the intermediate transfer belt 24, i.e., relative to the transfer nip.

Further, the position of the intermediate transfer roller 38-1 in the vertical direction can be located so that the uppermost part of the center line of the intermediate transfer roller 38-1 is located upper relative to the tangent line drawn from the lowermost part of the center line of the photosensitive drum 14-1. By such location of the intermediate transfer roller 38-1, the intermediate transfer belt 24 can contact the photosensitive drum 14-1 with a winding power angle, and the width of the transfer nip can be on the order of 1 mm.

The positional relationship of the intermediate transfer roller 38-1 with the photosensitive drum 14-1 is similar to the rest of photosensitive drums 14-2 to 14-4 and the intermediate transfer rollers 38-2 to 38-4 in FIG. 1.

Furthermore, FIG. 3 shows the current flow to the transfer nip when the primary transfer voltage 40 is applied to the intermediate transfer roller 38-1 located oppositely to the photosensitive drum 14-1 with the intermediate transfer belt 24 therebetween. For example, taking an example of the intermediate transfer roller 38-1, if a prescribed direct current voltage, for example, 800 V is applied thereto, the current due to the applied voltage flows, depending on the resistance in the surface direction of the intermediate transfer belt 24 as shown by the arrows 62, to the position of the transfer nip that is the belt contact point of the corresponding photosensitive drum 14-1.

That is, the current flows in the lateral direction of the intermediate transfer belt 24 from the transfer roller 38-1 toward the position of the transfer nip. A part of the current subsequently flows in the thickness direction, i.e., the direction along which the volume resistance is effective, however, most of the current flows laterally depending on the resistance of the surface of the intermediate transfer belt 24.

Simultaneously, current flows from the intermediate transfer roller 38-1 to the other photosensitive drum 14-2, and the current depends on the distances from the belt contact point of the intermediate transfer roller 38-1 to the transfer nips of the photosensitive drums 14-1 and 14-2. The smaller the distance is, the greater the amount of flowing current is.

As described above, in the primary transfer, it is found that the transfer voltages depend on the surface resistance in the belt surface direction because the current flowing into the transfer nips of the photosensitive drums by applying the voltages to the intermediate transfer rollers is mainly the current along the belt surface direction.

That is, as shown in FIG. 4 by the equivalent circuit, the primary transfer current flows from the power supply 40 via the transfer roller 38-1 through the resistance R along the lateral direction of the intermediate transfer belt 24 into the transfer nip of the photosensitive drum 14-1.

In the transfer method utilizing the resistance along the surface direction, as shown in FIG. 3, when applying the transfer voltage from the vicinity of the transfer point (transfer nip) via the transfer means 38-1, the current 62 flows as shown by the arrow in the FIG. 3. Since the part affected by the volume resistivity is the part where the current flows along the thickness direction, the transfer current is affected less than in the part where the current flows along the surface. That is because, while the thickness of the transfer belt 24 is 100 to 150 $\mu$m, the distance from the transfer point to the transfer means 38-1 is separated from 2 to 20 mm, therefore, the transfer current is determined extremely largely depending on the surface resistivity.

In the conventional transfer method utilizing the volume resistance, since the voltage is applied in the thickness direction of the thin transfer belt 24, if the high transfer voltage is applied, the transfer belt 24 is easily deteriorated by the high electric field due to its thin thickness. On the other hand, in the transfer method utilizing resistance along the surface direction used in the present invention, since the distance between the transfer nip position (transfer point) and the transfer means 38-1 can be provided, the resistance value R between the point to which the transfer voltage is applied and the transfer nip position is stable even when the transfer voltage varies. On this account, since the resistance value does not vary even when the high transfer voltage is applied, the electrical characteristic (resistance value) of the transfer belt is hardly deteriorated. Therefore, even when high speed printing is performed, the deterioration of the transfer belt is reduced, and the stable transfer can be performed.

Moreover, since the transfer roller can be disposed in the position displaced from the photosensitive drum, the above-described metal roller can be used as the transfer roller. Relative to the sponge conductive roller, the metal roller has greater durability, provides lower cost, and produces no waste of sponge etc., and thereby, the high speed printer with lower cost and greater durability can be provided.

Next, the surface resistivity and the volume resistivity of the intermediate transfer body (belt) 24 in the transfer method utilizing the resistance along the surface direction will be described. In the conventional color image forming device using the intermediate transfer method utilizing volume resistance (resistance in the thickness direction), the electric resistance of the intermediate transfer body (belt form, drum form) is set as volume resistivity (Ω·cm) ≦surface resistivity (Ω/sq.), which is disclosed in Japanese Patent Application Laid-Open Nos. 10-228188, 2000-147920 and the like, for example.

The above described relationship between the volume resistivity and the surface resistivity is mainly for suppressing dust (toner is scattered and deteriorates the image). That is, by setting the surface resistivity of the intermediate transfer body to be higher, the field unnecessarily spreading in front and behind the transfer nip is suppressed, and thereby, the toner 74, as shown in FIGS. 3 and 4, is prevented from being electrically scattered.

Regardless of the primary transfer (to transfer toner from photosensitive body onto the intermediate transfer body) or the secondary transfer (to transfer from the intermediate transfer body onto recording medium), in a transfer method for applying the transfer voltage not in the thickness direction, but along the surface direction of the intermediate transfer body (the method utilizing the resistance along the surface of the intermediate transfer body), as described above, the transfer efficiency largely depends on the surface resistance of the intermediate transfer body. That is, in order to allow the predetermined transfer current to flow to obtain sufficient transfer efficiency, a higher transfer voltage is required for an intermediate transfer body with higher surface resistance.

On the other hand, dust at the time of transfer is reduced with higher resistance (surface resistance, volume resistance) of the intermediate transfer body, and increased with higher transfer voltage.

Accordingly, in the method utilizing the resistance along the surface direction of the intermediate transfer body, if the intermediate transfer body is used, the intermediate transfer body having higher surface resistance than the volume resistance, which is suggested in the conventional transfer method utilizing the resistance along the thickness direction, the requirements for suppressing dust and for improving transfer efficiency are in trade-off relation, and hard to be compatible.

On this account, the inventors of the invention found that the following relation is effective to suppress the dust and improve the transfer efficiency in the transfer method utilizing the resistance along the surface direction as a result of the various studies on the volume resistivity and the surface resistivity of the intermediate transfer body in the transfer method utilizing the resistance along the surface direction.

volume resistivity(Ω·cm)>surface resistivity(Ω/sq.)

That is, as described by referring to FIG. 3, the lower the surface resistivity is, the lower the required transfer voltage becomes. On this account, the transfer with a low transfer voltage can be performed, whereby the transfer efficiency can be improved, and since the transfer voltage is low, generation of dust can be prevented. Concurrently with this, due to the volume resistivity set to be higher, the charge holding capability of the belt is assured, the electrical adsorption power (image force) of the toner to the belt is improved, and the dust is reduced.

In other words, the lower surface resistivity enables the larger current to flow along the surface of the transfer belt, and makes the transfer easier to perform. That is, the transfer efficiency is improved, and the required transfer voltage becomes lower. In the tandem type device in FIG. 1, when the surface resistivity is lowered and the distance between the drums is shortened, for example, because the current flows not only into the photosensitive drum 14-1, but also into the adjacent photosensitive drum 14-2 the current of the transfer roller affects the transfer. However, as shown in FIGS. 1 and 2, since the primary transfer voltages are made to be a common voltage among the transfer rollers 38-1 to 38-4, the transfer operation will not be adversely affected even if the current flows.

On the other hand, it is necessary that, after transfer, the toner is conveyed by being electrostatically adhered to the transfer belt 24, and the more the charge is accumulated on the transfer belt 24, the more stably the belt is carried. On this account, the larger the volume resistivity is, the less the charge attenuation on the belt passed through the transfer nip is, and the more the dust can be suppressed.

In relation to the range of the volume resistivity, if the volume resistivity is too large, the charge is accumulated too much, and the transfer voltage increases at the next transfer. Especially, in the intermediate transfer type device of tandem type, the spacings between the photosensitive drums are narrow (for example, 50 mm or less), and rapid attenuation of the charge is desired in order to lower the transfer voltages of the respective colors.

Since the attenuation of the transfer belt is determined by the relaxation time expressed by the volume resistivity and the dielectric constant, the volume resistivity has an upper limit. Further, if the volume resistivity is too low, the leakage of the charge occurs and the transfer cannot be performed. Therefore, there is a preferable range for the volume resistivity.

As a result of an experiment in light of the matter described above, good results are obtained in the range of the volume resistivity from $1\times10^{9}$ Ω·cm to $1\times10^{12}$ Ω·cm under the condition with applied voltage of 500 V and application time of 10 seconds. At this time, the transfer efficiency is better and the transfer can be performed with the lower voltage when the surface resistivity is lower than the voltage resistivity.

In the case of the secondary transfer, similarly, the transfer method utilizing the resistance along the surface direction can be used, and the similar condition can be applied. Note that, since the secondary transfer is not affected essentially by the volume resistivity, there is no problem if the volume resistivity lies within the above mentioned value range. Because the toner is transferred onto the medium 50 at the secondary transfer nip portion, subsequent toner behavior depends on the medium and irrelevant to the transfer belt.

As described above, the higher the volume resistivity of the intermediate transfer body is, the less the dust in transfer is generated, and also, the lower the surface resistivity is, the better the transfer efficiency becomes. That is, the transfer can be performed with low voltage.

Namely, when the volume resistivity is large, the field at the transfer nip is difficult to arise, and the dust before transfer is reduced. Concurrently with this, the charge attenuation after the passage of the transfer nip becomes slower, and thereby, the force for holding the toner on the transfer belt becomes stronger. Further, as shown in FIG. 3, when the surface resistivity is lower, a larger current flows along the surface of the transfer belt, and the transfer becomes easier to be performed.

Therefore, the belt with high volume resistivity and low surface resistivity is effective. If the volume resistivity is too low, leakage occurs, and if it is too high, the volume resistivity in addition to the surface resistivity effects the transfer efficiency and lowers the transfer efficiency. Consequently, it is desirable that the volume resistivity lies within the range from $1\times10^{9}$ to $1\times10^{12}$ Ω·cm.

Furthermore, actually, it is difficult to form the transfer belt with the volume resistivity and the surface resistivity varied independently and without restraint, and therefore, there is a natural limitation. On this account, at least making the surface resistivity lower than the volume resistivity is effective. Practically, the range of the surface resistivity available for production differs from the volume resistivity by 0.5 to 1 orders if the volume resistivity is constant. In the case of the invention, it is preferred that the surface resistivity lies within the range of $10^{8}$ to $10^{11}$ Ω/sq. Note that the surface resistivity is the resistivity per unit area, and the wider the width becomes, the higher the resistance becomes. However, there is no linear relationship between them.

Turning to FIG. 2, the developing units 22-1 to 22-4 will be described. The developing units 22-1 to 22-4 stir one-component developer (toner) thrown from the respective toner cartridges 20-1 to 20-4, and feed it to the photosensitive drums 14-1 to 14-2. That is, the respective developing units 22-1 to 22-4 are constituted by developing rollers 71 for feeding the developer to the photosensitive drums 16-1 to 16-4, reset rollers 73 for stirring internal developer and feeding the developer to the developing rollers 71, and blades 72 for restricting the thicknesses of the developer layers on the developing rollers 71.

To these developing units 22-1 to 22-4, developing bias voltages are supplied from a developing bias power supply 70. In this embodiment, from the developing bias power supply 70, blade bias voltages, developing bias voltages, and reset bias voltages are supplied. As will be described later, the developing bias power supply 70 supplies the respective developing units 22-1 to 22-4 with independent bias voltages Y, M, C, and K so as to independently control the charge amounts of toner of the respective colors.

[First Color Image Forming Method]

Figure 5:
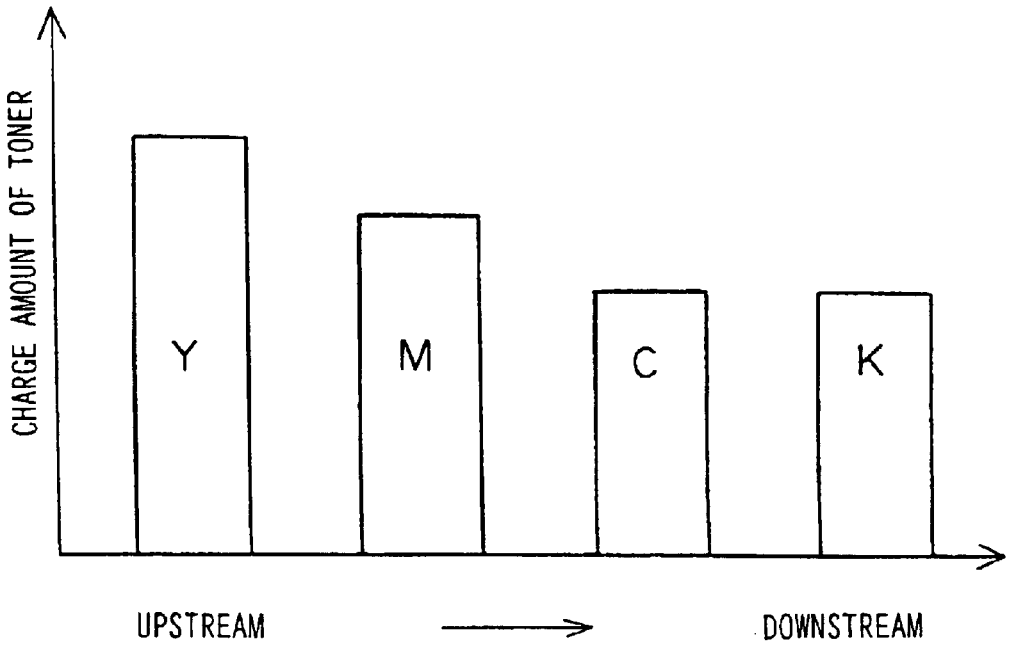
FIG. 5 is an explanatory view of the charge amounts of the toner of the respective colors in the one embodiment of the invention.
Figure 6:
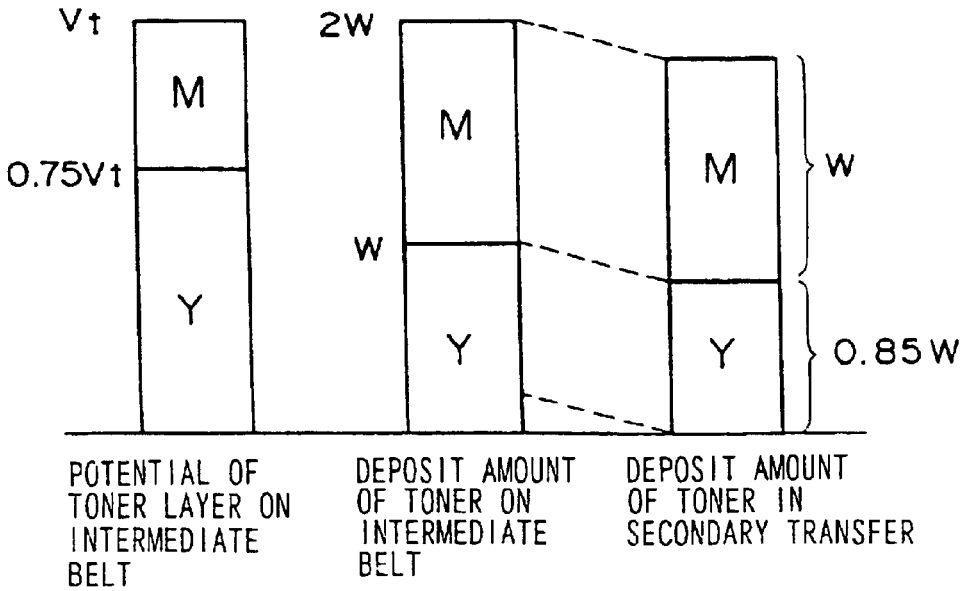
FIG. 6 is an explanatory view of the secondary transfer principle in the one embodiment of the invention.
Figure 7:
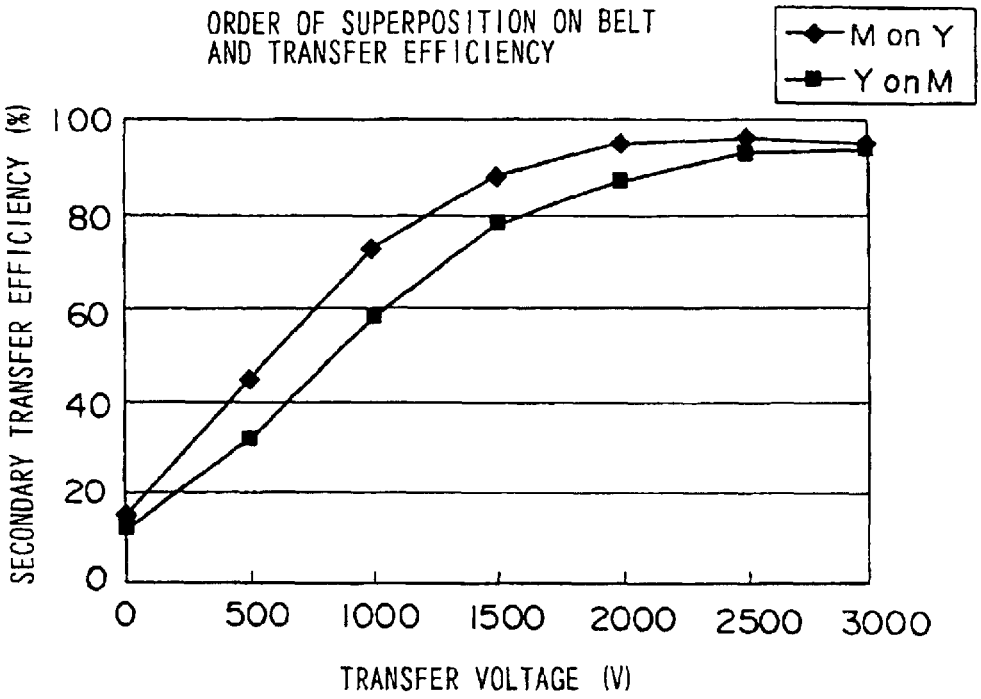
FIG. 7 is an explanatory view for explanation of the effect of the secondary transfer in the one embodiment of the invention.

FIG. 5 is a characteristic diagram of the charge amounts of the toner of the respective colors in the first embodiment of the invention, FIG. 6 is an explanatory diagram of the secondary transfer operation with the charge amounts shown in FIG. 5, and FIG. 7 is an explanatory diagram of the effect of the secondary transfer shown in FIG. 6.

First, basically for transfer, if the potential having reverse polarity to the potential Vt of the toner layer is applied, the theoretical transfer efficiency becomes 100%. For improvement of the transfer efficiency, the transfer voltage should be increased, but, since the influence of discharge is exerted, the upper limit is restricted. In the secondary transfer, when the transfer voltage is used at the upper limit or lower, the toner that directly contacts with the intermediate belt 24 of the toner layers of the secondary color (two layers) becomes difficult to be transferred. For example, assuming that the transfer efficiency is 50%, the upper toner of the superposed two colors is transferred 100%, however, the toner directly mounted on the belt is transferred 0%, i.e., not transferred.

Therefore, in the invention, a measure is taken so that the toner directly mounted on the belt is easily transferred at the time of the secondary transfer. In relation to the primary transfer, the transfer is performed basically on monochromatic toner, and the transfer efficiency has wide margins. On this account, the charge amount of the toner can be widely ranged from −5 to −35 μC/g. The invention utilizes this point to increase the secondary transfer efficiency.

As shown in FIG. 5, the charge amount of the toner is made larger (higher) for the color placed on the upstream side of the intermediate transfer belt 24, and the charge amount of the toner is made smaller (lower) for the color placed on the downstream side. In the embodiment in FIGS. 1 and 2, the charge amount is made larger for yellow (Y) on the upstream side, and the charge amount is made smaller for cyan (C) on the downstream side.

As shown in FIG. 6, superposition is performed so that, of the toner layers of the secondary color (two layers) on the intermediate transfer belt 24, the potential of the toner layer (Y) in direct contact with the belt 24 is made higher, and the potential of the upper toner layer (M) deposited by the superposition is made lower. That is, the toner of the respective colors is superposed on the intermediate transfer belt 24 in descending order of the charge amount thereof.

For example, as shown in FIG. 6, in the case where the ratio of the potential of the toner layer (Y) directly adhered to the belt 24 and the potential of the toner layer (M) superposed thereon is made 3:1, the upper toner layer (M) is transferred onto the medium 100% as well as in the conventional case. Since the toner layer (Y) directly adhered to the belt has the charge amount 1.5 times larger than that in the conventional case, the amount of the secondary transfer becomes 1.5 times larger than that in the conventional case. For example, under the condition that the deposit amount W on the intermediate transfer belt 24 is made equal and the conventional secondary transfer voltage with the transfer efficiency of 75% is applied, since the toner layer (Y) adhered to the belt is transferred 1.5 times larger, the transfer efficiency is improved to (50+25×1.5=) 87.5%.

As described above, the superposition is performed so that the potential of the toner layer (Y) directly adhered to the belt 24 is made higher, and the potential of the upper toner layer (M) deposited by the superposition is made lower, and thereby, the secondary transfer voltage equal to that in the conventional case results in improving the transfer efficiency.

FIG. 7 is an explanatory diagram of an experimental example of the secondary transfer efficiency in the superposition in the case where the charge amounts of the magenta toner (M) and the yellow toner (Y) are varied and the toner layer potentials are varied. As an example, two kinds of toner (Y, M) is prepared by varying the external additive for the toner (silica powder) to adjust the charge amount.

Here, the charge amount of Y (yellow) is made higher by the external additive and the charge amount of M (magenta) is made lower by the external additive. The toner layer potentials of the toner on the developing roller are −48 V for Y (yellow) and −23 V for M (magenta). The toner layer potentials after the primary transfer are −71 V for single color Y and −32 V for single color M, and the toner layer potential after superposition is −98 V. The higher toner layer potential is caused by that the velocity ratio of the developing roller and an OPC drum is 1.25 and the toner layer (toner amount) on the drum is greater than that on the developing rollers.

The result of the secondary transfer efficiency experimentation with the two kinds of toner, when the order of the superposition of Y and M is varied, is shown in FIG. 7. The transfer efficiency is far better in the case of superposing M having lower toner layer potential on Y having higher toner layer potential (M on Y) on the belt than in the case of superposing Y having higher toner layer potential on M having lower toner layer potential (Y on M) on the belt. Specifically, it is clear that the transfer efficiency is improved with the low secondary transfer voltage (500 V to 2000 V). Thus, it is found that the transfer efficiency is better in the case of forming Y having higher toner layer potential first on the belt in the secondary transfer of the secondary color.

As described above, by transferring toner in descending order of charge amounts onto the intermediate transfer body, the secondary transfer efficiency can be improved. Further, the reproducibility of the secondary color is improved and a high quality color image can be formed.

Figure 8:
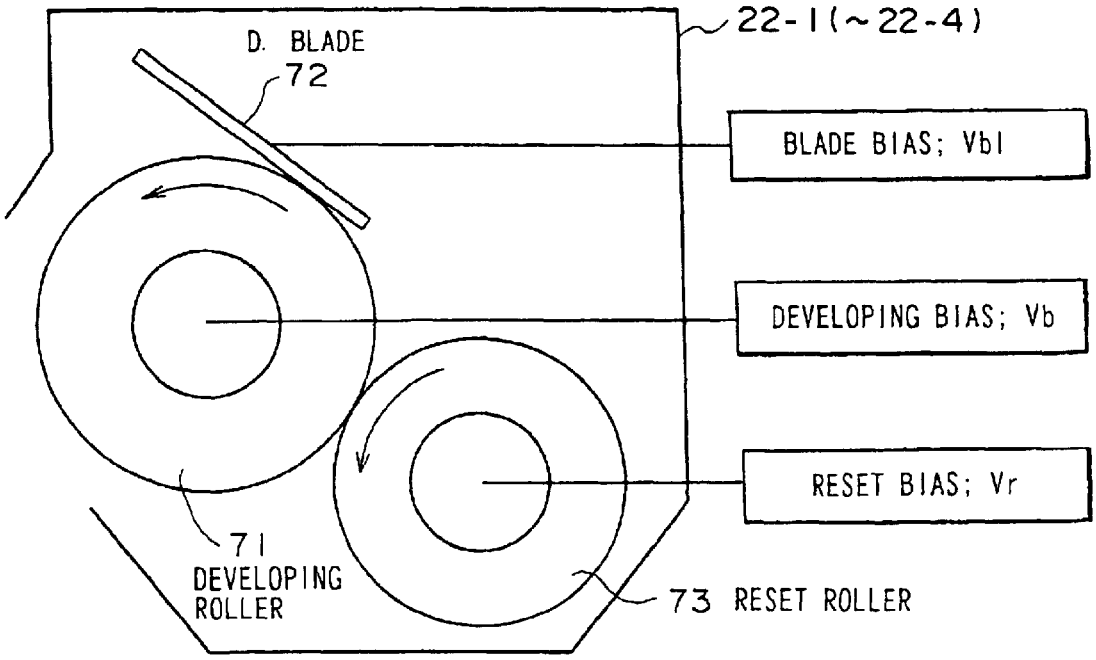
FIG. 8 is a structural view of the developing unit in FIG. 1.

Next, the above method for varying the toner layer potentials of the respective colors will be described by referring to a structural diagram of the developing unit in FIG. 8, and a characteristic diagram of toner charge-to-mass ratio in FIG. 9. As shown in FIG. 8, the one component developing units 22-1 to 22-4 are constituted by developing rollers 71 contacting the photosensitive drums, toner layer forming blades 72, and reset rollers 73. The blade bias voltage Vbl is supplied to the toner layer forming blade 72, and the reset bias voltage Vr is supplied to the reset roller 73, and the voltages applied to the blades 72 and reset rollers 73 are independently controlled for respective colors. Additionally, the developing bias voltage Vb is applied to the developing roller 71.

In order to vary the toner layer potential, it is required that the charge amount of toner or the deposit amount of toner is varied, and it is more effective to vary the charge amount (charge-to-mass ratio) of toner. As a method for varying the toner charge amount, in the invention, the electrical development condition of the developing unit is varied. FIG. 9 shows the measurement result of the toner charge-to-mass ratio ($-\mu$C/g) in the case where the blade bias potential Vbl and the reset bias potential Vr are varied.

The toner charge-to-mass ratio is varied both in the case where the blade bias potential Vbl is varied (dotted line in the figure) and the reset bias potential Vr is varied (solid line in the figure). Therefore, any one or both of the blade bias potential Vbl and the reset bias potential Vr is/are varied for respective colors (at least three colors of Y, M, and C,) and the toner charge-to-mass ratio ($-\mu$C/g) of the respective colors is varied. In this case, the toner charge-to-mass ratio is varied so as to make the toner charge-to-mass ratio smaller in the order of Y, M, and C. Thus, by varying the toner charge-to-mass ratio by the electrical control of the developing units, the charge-to-mass ratio can be varied without changes in developer components.

Figure 10:
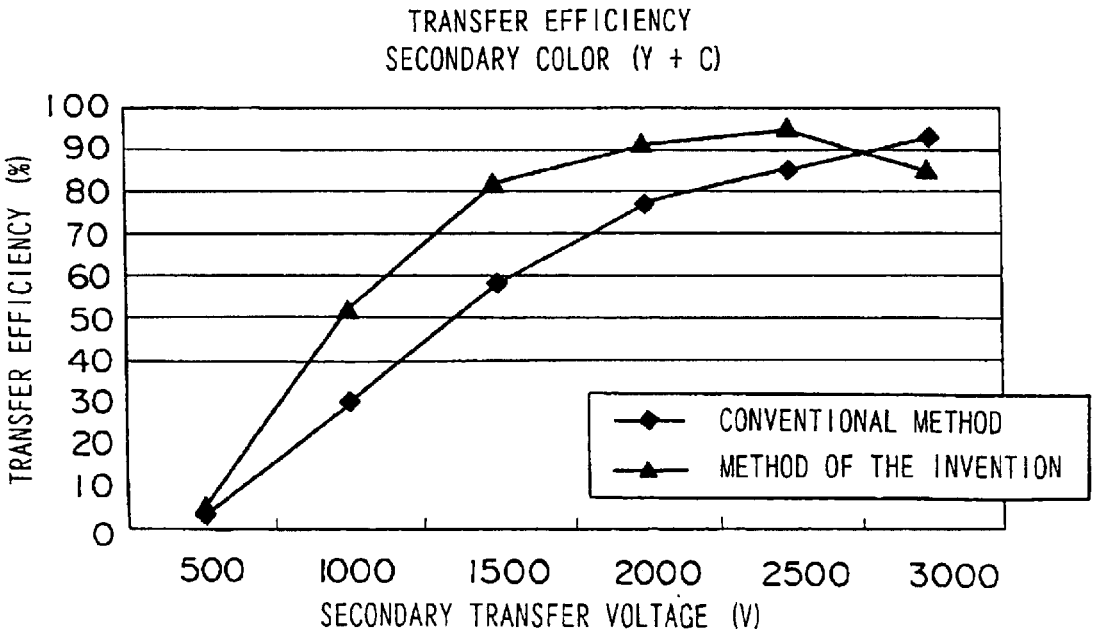
FIG. 10 is a characteristic view of the transfer efficiency in the secondary transfer method in FIG. 6.

FIG. 10 is a characteristic diagram of the secondary transfer efficiency in the example of the invention. FIG. 10 is the characteristic diagram of the transfer efficiency (deposit amount transferred to medium/deposit amount on intermediate transfer belt) of the secondary color (Y+M) when the secondary transfer voltage V supplied to the secondary transfer roller 45 is varied in the color printer having the structure in FIGS. 1 and 2. The experimental condition of the example is as follows.

toner: negatively charged toner (average particle diameter 7.6 $\mu$m)

Resistance of developing roller 71: $10^6$ Ω·cm

Resistance of reset roller 73: $10^5$ Ω·cm

Toner layer forming blade 72: thickness 0.1 mm

Developing bias potential Vb: −300 v

Toner layer forming blade bias potentials Vbl

Yellow Vbly: −500 V

Magenta Vblm: −450 V

Cyan Vblc: −430 V

Black Vblb: −400 V

Reset bias potential Vr: −500 V

Charging brush voltages

Offset Vdoffset: −650 V

AC Peak to Peak Vp-p: 1100 V

Intermediate transfer belt 24: volume resistance 2E+9 Ω·cm, thickness 150 $\mu$m Resistance of primary transfer rollers 38-1 to 38-4: 5E +5 Ω·cm Resistance of secondary transfer roller 45: 5E+6 Ω·cm Primary transfer voltages:

Yellow Vty: −800 V

Magenta Vtm: −950 V

Cyan Vtc: −1050 V

Black Vtb: −1200 V

As shown in FIG. 10, it is found that, in the experimental example of the invention in which toner charge-to-mass ratio is varied and the charge-to-mass ratio is superposed in descending order of amount (solid line in the figure), the transfer efficiency is extremely improved compared to the case where the charge-to-mass ratio is equal among the respective colors (dotted line of the figure). Specifically, the tendency is remarkable with the low secondary transfer voltage (500 V to 2000 V), and the high transfer efficiency with the low transfer voltage can be realized.

Figure 9:
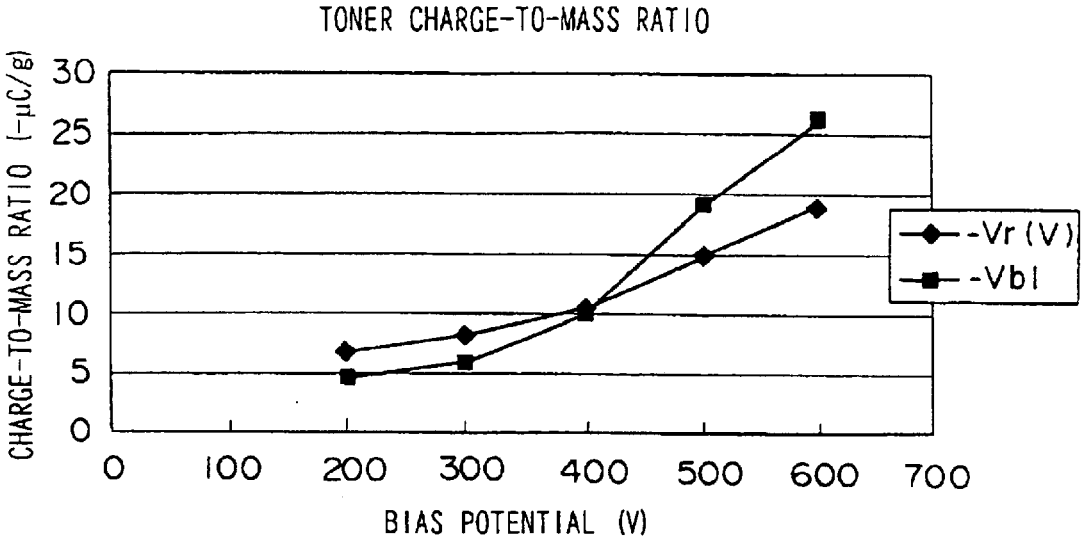
FIG. 9 is a characteristic view of the bias potential and the toner charge-to-mass ratio of the developing unit in FIG. 8.

In the example of FIG. 10, the reset bias is made common, and the blade biases are varied among the respective colors, however, as described by referring to FIG. 9, also by varying the reset biases for respective colors, the charge amount of toner can be varied.

[Second Color Image Forming Method]

Figure 11:
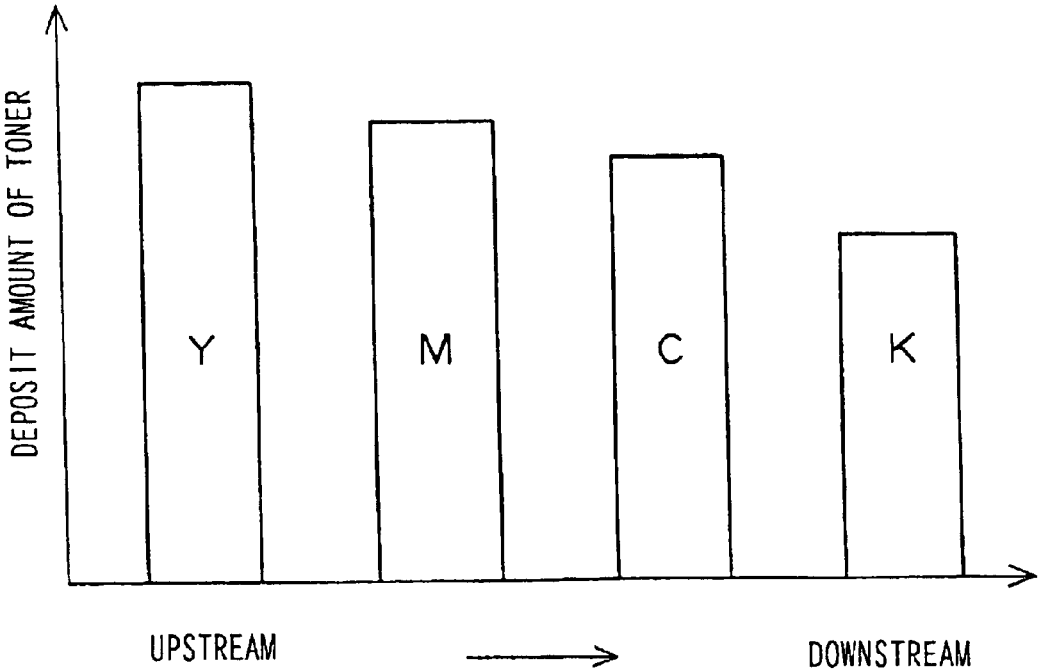
FIG. 11 is a view showing the relationship of deposit amounts of toner in another embodiment of the invention.
Figure 13:
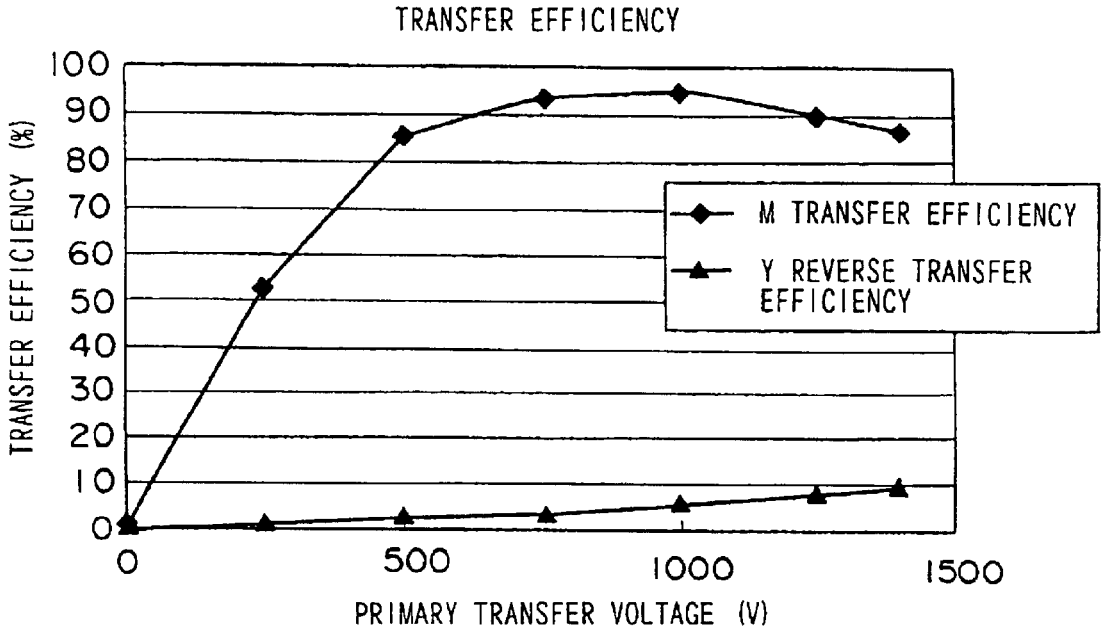
FIG. 13 is a view showing the relationship between the transfer efficiency and the reverse transfer efficiency in FIG. 12.
Figure 14:
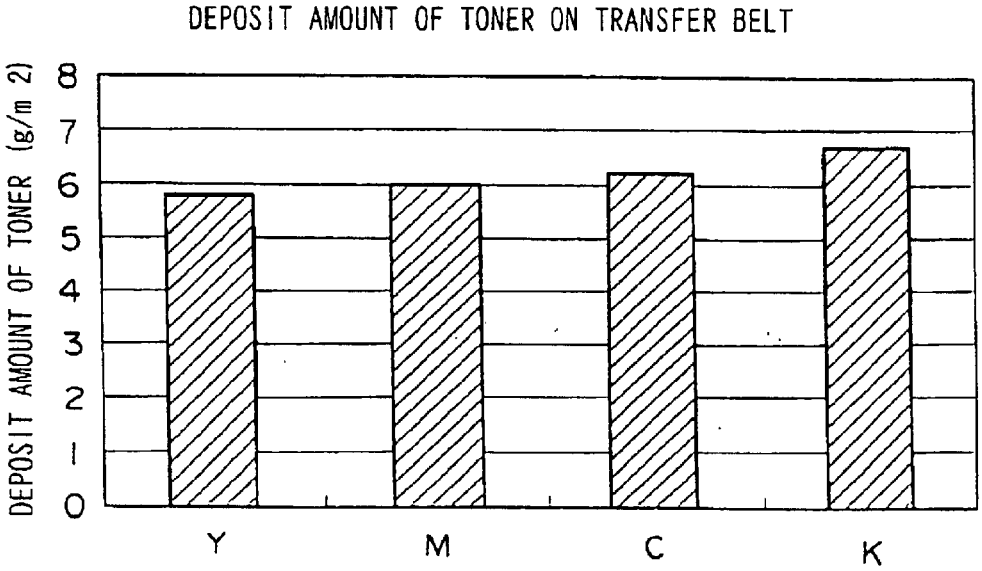
FIG. 14 is an explanatory view of the deposit amount of toner of the respective colors before the secondary transfer due to the reverse transfer in FIG. 12.

Next, as another embodiment of the invention, the method for uniforming the deposit amount of toner of the respective colors on the intermediate transfer belt 24 will be described. FIG. 11 is an explanatory diagram of the deposit amount of toner of each photosensitive drum in another embodiment of the invention, FIG. 12 is a model diagram for explaining the cause of the reduction of the deposit amount as a basis of the invention, FIG. 13 is a characteristic diagram when the magenta toner is transferred, and FIG. 14 is an explanatory diagram of the deposit amount of toner of the respective colors on the intermediate belt according to the phenomenon in FIG. 12.

In the color image forming method using the intermediate transfer body, when the toner of the respective colors is sequentially transferred at the primary transfer parts, of the toner already formed on the transfer belt 24, the portions with no superposition of the toner in the transfer parts at the respective primary transfer parts are only passed through the drums at the transfer parts.

Figure 12:
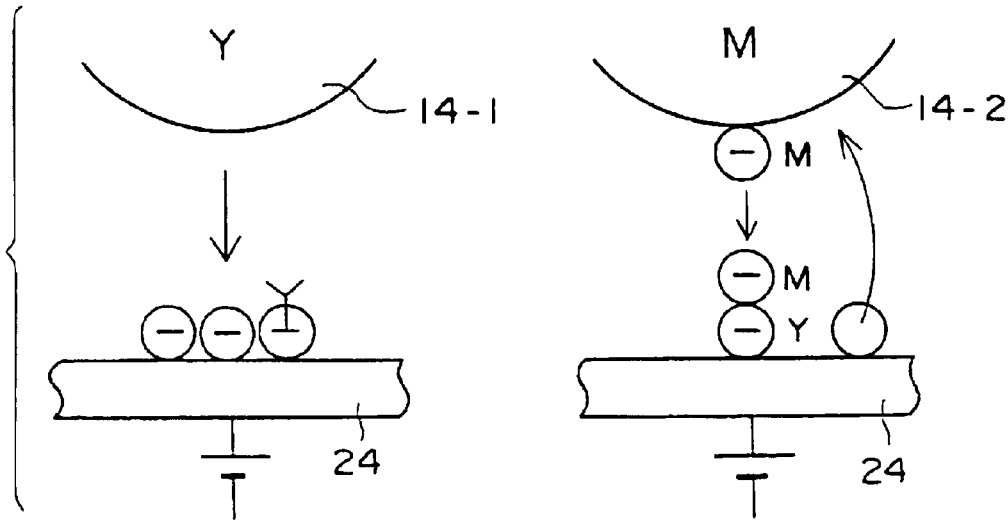
FIG. 12 is an explanatory view of the reverse transfer operation for explaining the problem in another embodiment of the invention in FIG. 11.

As shown in FIG. 12, at this time, the toner Y formed on the transfer belt 24 includes uncharged toner or reversely charged toner. On this account, when the magenta (M) toner is transferred, the phenomenon that the yellow toner on the intermediate transfer belt 24 is transferred onto the magenta photosensitive drum 14-2 (referred to as reverse transfer) from the intermediate transfer belt 24 occurs by the magenta transfer voltage. Thus, the deposit amount of the yellow toner on the intermediate transfer belt 24 is reduced.

For example, assuming that the primary transfer is performed in the order of Y, M, C, and K, the deposit amount of Y toner is being reduced little by little by the reverse transfer at the time of transfer of M, C, and K. Therefore, as shown in FIG. 14, under the same development condition, the deposit amounts of toner on the transfer belt 24 before the secondary transfer are larger in the order of Y, M, C, and K. FIG. 13 shows the transfer efficiency of M toner and the amount of the reverse transfer of Y toner when the M (magenta) toner is transferred. With making the transfer voltage higher, the transfer efficiency of M toner becomes higher, while the amount of the reverse transfer of Y toner is increasing.

Thus, the difference remains in the deposit amount after the second transfer, and effects on the color printing quality. In other words, a problem arises that Y (yellow) is light, and following M, C, and K are darker in terms of density in this order.

In this embodiment of the invention, the deposit amounts of the toner on the drums are controlled in advance, so that the above-described problem can be solved and the deposit amounts of the toner of the respective colors can be uniform at the secondary transfer part. That is, as shown in FIG. 11, the deposit amounts of the toner are made smaller from the upstream side toward the downstream side in the order of Y, M, C, and K to make the deposit amounts of the toner of the respective colors uniform at the secondary transfer part.

It is effective that the electrical development condition of the developing units is varied. That is, as shown in FIG. 8, the one component developing units 22-1 to 22-4 are constituted by developing rollers 71 contacting the photosensitive drums, toner layer forming blades 72, and reset rollers 73. The blade bias voltage Vbl is supplied to the toner layer forming blade 72, and the reset bias voltage Vr is supplied to the reset roller 73, and the voltages applied to the blades 72 and reset rollers 73 are independently controlled for respective colors. Additionally, the developing bias voltages Vb are applied to the developing rollers 71 and independently controlled for respective colors.

Figure 15:
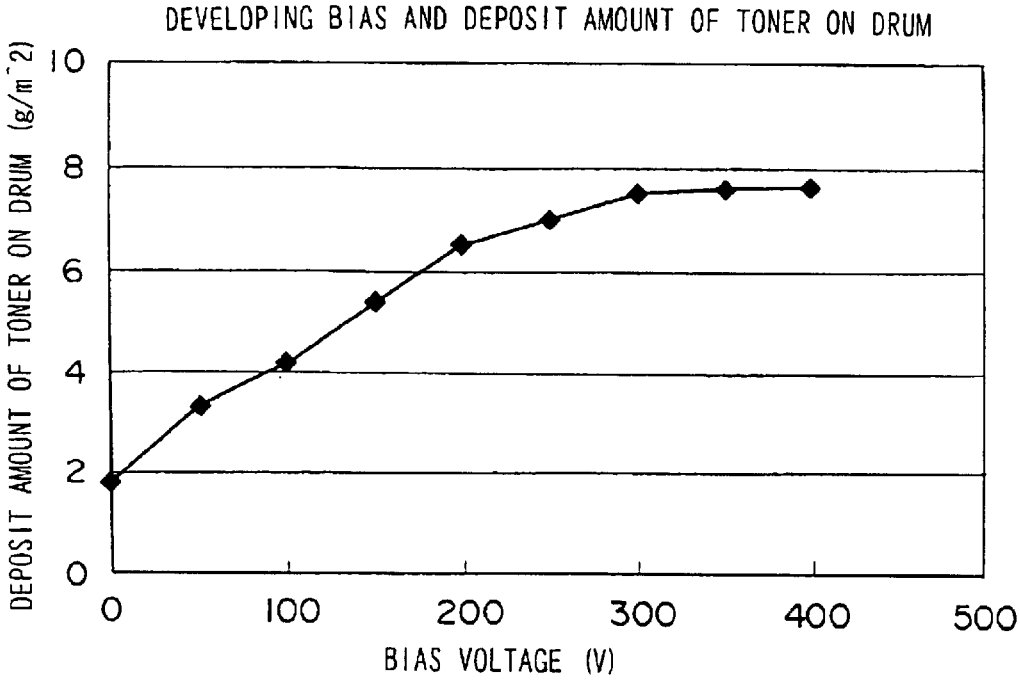
FIG. 15 is a view showing the relationship between the developing bias and the deposit amount of the toner on the drum for realizing FIG. 11.

FIG. 15 is a diagram showing the relationship between the developing bias voltage in the one component developing unit and the deposit amount (g/m$^2$) of the toner deposited on the photosensitive drum. If the developing bias voltage is increased, the deposit amount is also increased, and if the developing bias voltage is decreased, the deposit amount is also decreased.

According to this, the developing bias voltages of the respective colors are made variable independently of each color, and thereby, the deposit amounts of the toner on the drums are made smaller in the order of Y, M, C, and K. That is, in the structure shown in FIG. 2, the developing bias voltages smaller in the order of Y, M, C, and K are supplied from the developing bias power supply 70 to the developing units 22-1 to 22-4 of the respective colors.

As the method for varying the deposit amounts of toner on the drums, there are a method of varying blade bias voltages applied to the toner layer forming blades 72, a method of varying pressure of the toner layer forming blades 72 to the developing rollers, and a method of varying the reset bias voltages to the reset rollers 73, other than the method of varying the developing bias voltages.

Figure 16:
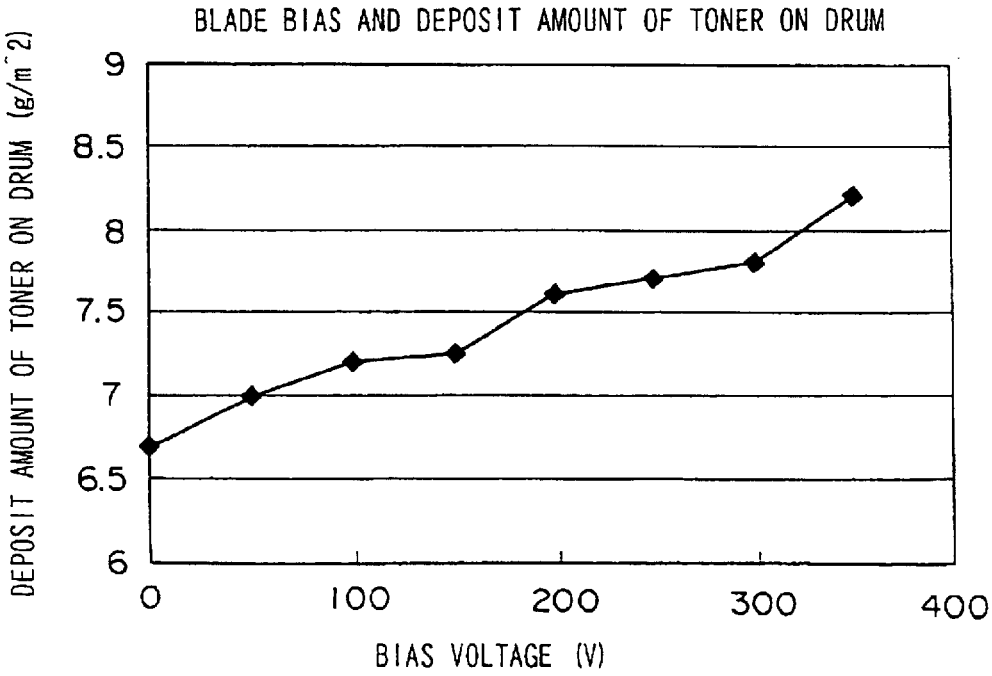
FIG. 16 is a view showing the relationship between the blade bias and the deposit amount of the toner on the drum for realizing FIG. 11.

FIG. 16 is a diagram showing the relationship between the blade bias voltage in the one component developing unit and the deposit amount (g/m$^2$) of the toner deposited on the photosensitive drum. If the blade bias voltage is increased, the deposit amount is also increased, and if the blade bias voltage is decreased, the deposit amount is also decreased.

Figure 17:
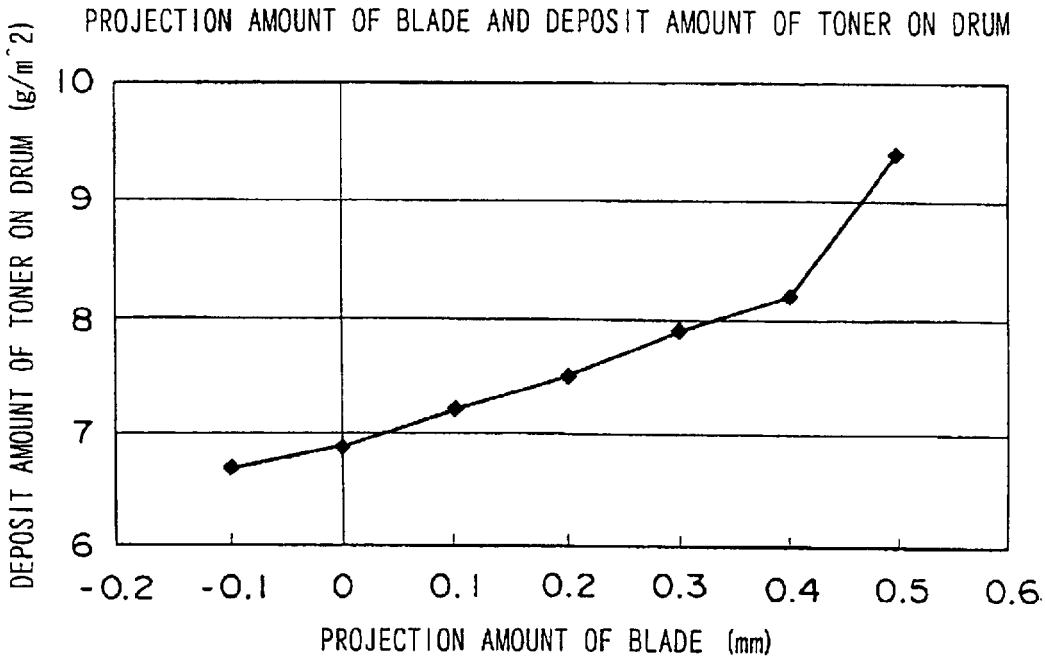
FIG. 17 is a view showing the relationship between the projection amount of the blade and the deposit amount of the toner on the drum for realizing FIG. 11.

FIG. 17 is a diagram showing the relationship between the blade pressure by the projection amount of the blade in the one component developing unit and the deposit amount (g/m$^2$) of the toner deposited on the photosensitive drum. If the projection amount of the blade is increased to reduce pressure, the toner layer thickness on the developing roller is increased and the deposit amount is also increased, and if the projection amount of the blade is decreased to increase pressure, the deposit amount is also decreased.

Figure 18:
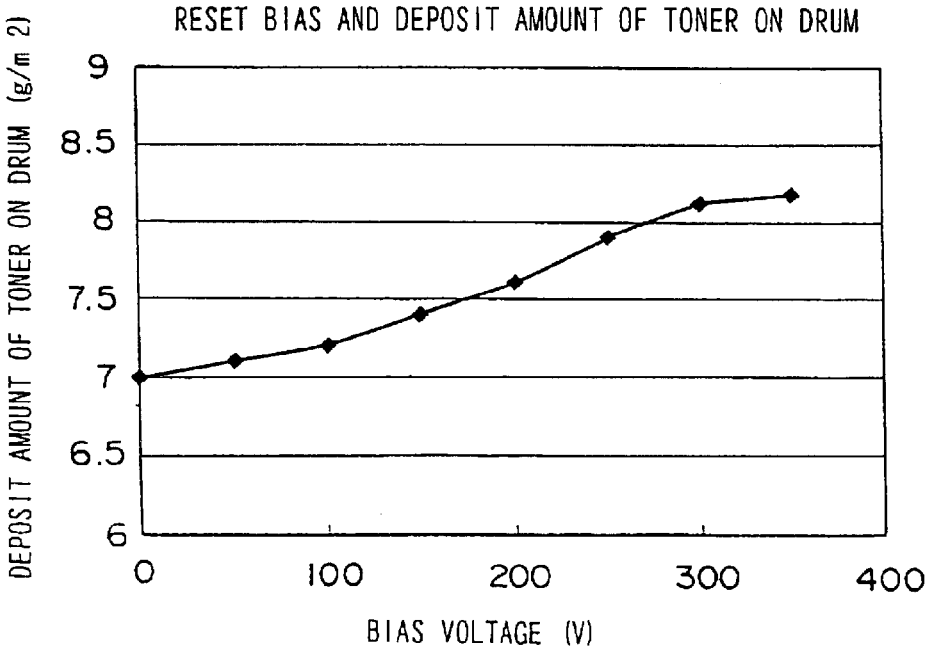
FIG. 18 is a view showing the relationship between the reset bias and the deposit amount of the toner on the drum for realizing FIG. 11.

FIG. 18 is a diagram showing the relationship between the reset bias voltage in the one component developing unit and the deposit amount (g/m$^2$) of the toner deposited on the photosensitive drum. If the reset bias voltage is increased, the deposit amount is also increased, and if the reset bias voltage is decreased, the deposit amount is also decreased.

The above-described parameters (bias voltage, blade pressure) may be applied independently, or, by combining the plural parameters, similar results can be obtained. Thus, by uniforming the deposit amount of toner of respective colors before the secondary transfer, a high quality color image can be obtained.

The experimental condition (standard settings) when the experiment is conducted using the color printer in FIGS. 1 and 2 is as follows.

Toner: negatively charged toner (average particle diameter 7.6 $\mu$m)

Resistance of developing roller 71: $10^6$ Ω·cm

Resistance of reset roller 73: $10^5$ Ω·cm

Toner layer forming blade 72: thickness 0.1 mm projection amount 0.1 mm

Developing bias voltage Vb: −300 V

Reset bias voltage Vr: Vb−100 V

Charging brush voltages

Offset voltage Vdoffset: −650 V

AC Peak to Peak Vp-p: 1100 V

Transfer belt 24: volume resistance 2E+9 Ω·cm, thickness 150 $\mu$m

Resistance of primary transfer rollers 38-1 to 38-4: 5E+5 Ω·cm

Resistance of secondary transfer roller 45: 5E+6 Ω·cm

Primary transfer voltage: 1100 V

The following developing bias voltages for increasing yellow and reducing black are applied for the respective colors according to the relationship between the developing bias voltage and the deposit amount of the toner on the drum in FIG. 15. As a result, the deposit amounts of the toner on the transfer belt 24 before the secondary transfer become uniform for the respective colors as 6.8 g/m$^2$.

Yellow Vby: −350 V

Magenta Vbm: −330 V

Cyan Vbc: −300 V

Black Vbk: −275 V

In the control of the charge amount in the first embodiment in FIG. 5, by varying blade bias voltages and reset bias voltages for the respective colors, both the charge amount and the deposit amount can be controlled. Further, by varying at least one of the blade bias voltages and the reset bias voltages, and varying the developing bias voltages for the respective colors, both the charge amount and the deposit amount can be controlled. Such method can be easily realized because it is necessary only to vary the electrical development condition of the developing units.

[Another Embodiment]

Figure 19:
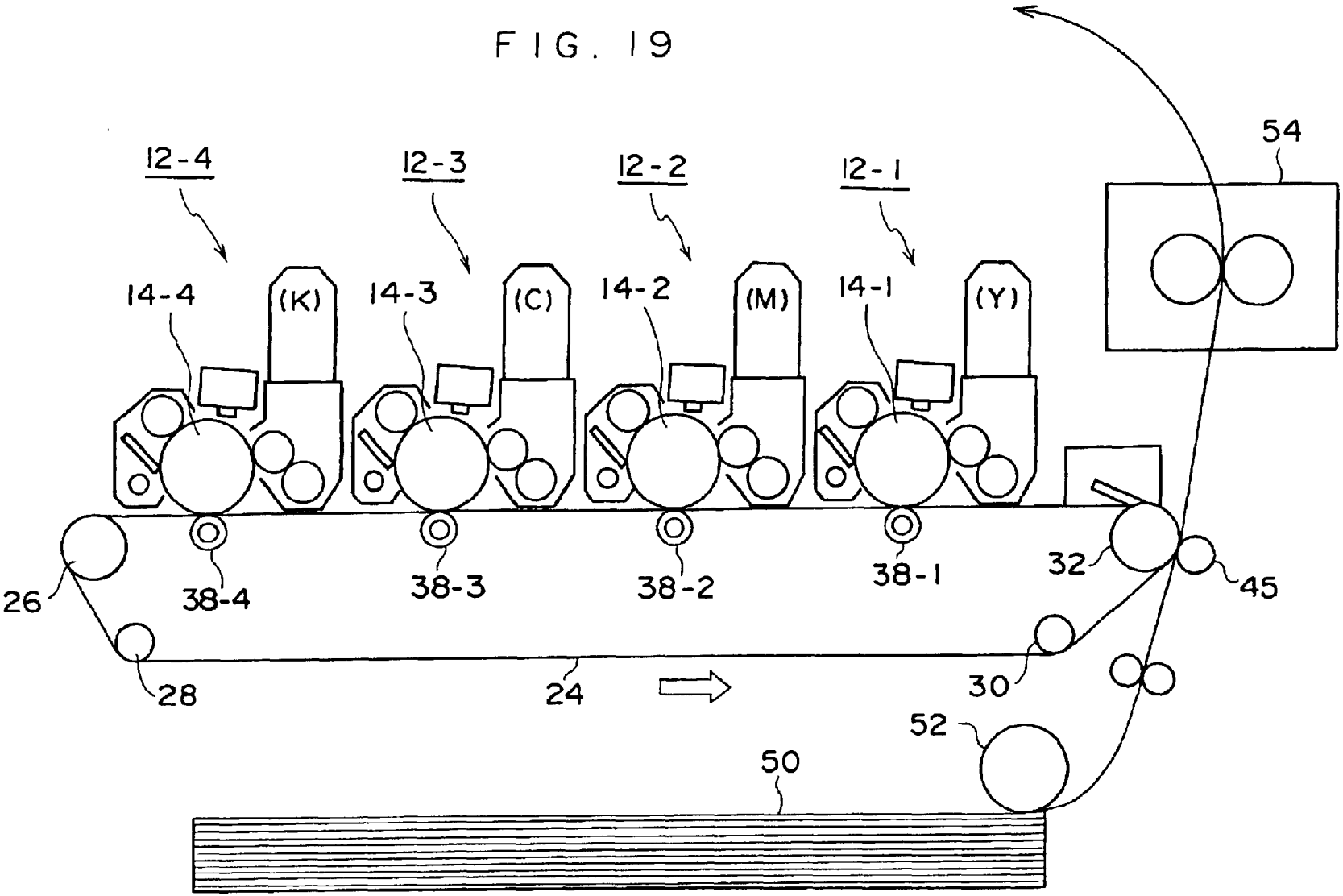
FIG. 19 is a structural view of an image forming device of another embodiment of the invention.

FIG. 19 shows another embodiment of the color printer to which the image forming device of the invention is applied. In FIG. 19, the same components as those in FIGS. 1 and 2 are shown by the same symbols.

First, in the color printer 10 in FIG. 1, the intermediate transfer belt 24 is disposed so as to be tensed at the three points by the driving roller 26, the backup roller 32, and the tension roller 35, and to reduce the belt space, however, in this example, a pair of tension rollers 28 an 30 are provided and variations in the belt tension are prevented.

Further, the arrangement of the intermediate transfer rollers 38-1 to 38-4 for the primary transfer, which are disposed corresponding to the photosensitive drums 14-1 to 14-4 of the image forming units 12-1 to 12-4 by being displaced oppositely with the intermediate transfer belt 24 therebetween is changed from that in FIG. 1. That is, intermediate transfer rollers 38-1 to 38-4 are disposed at the transfer nips of the photosensitive drums 14-1 to 14-4.

In this example, the above described control method of charge amounts and deposit amounts of toner for the respective colors can be also applied. Alternatively, the positions of the intermediate transfer rollers may be not only on the downstream side but also on the upstream side, and further, they may be disposed by dividing on the downstream side and on the upstream side.

Figure 20:
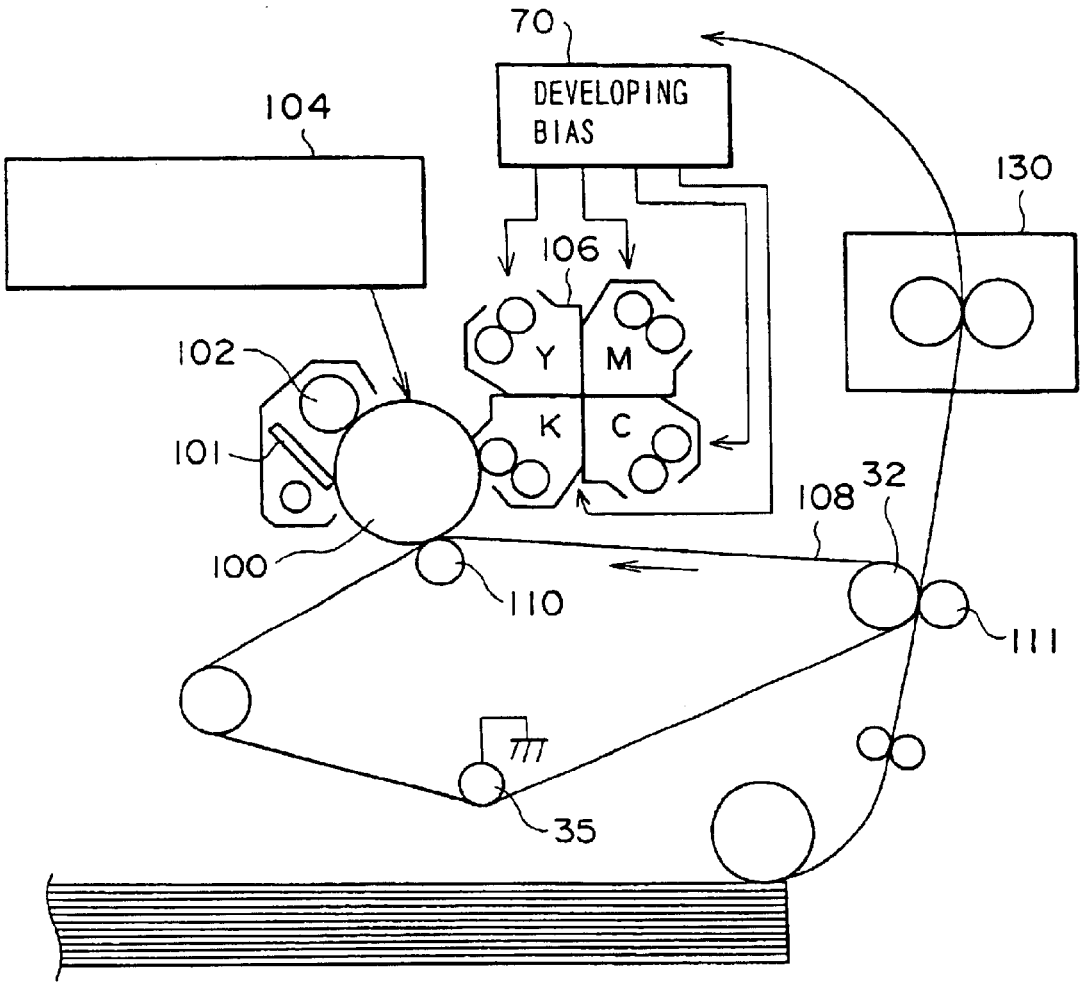
FIG. 20 is a structural view of an image forming device of still another embodiment of the invention.
Figure 21:
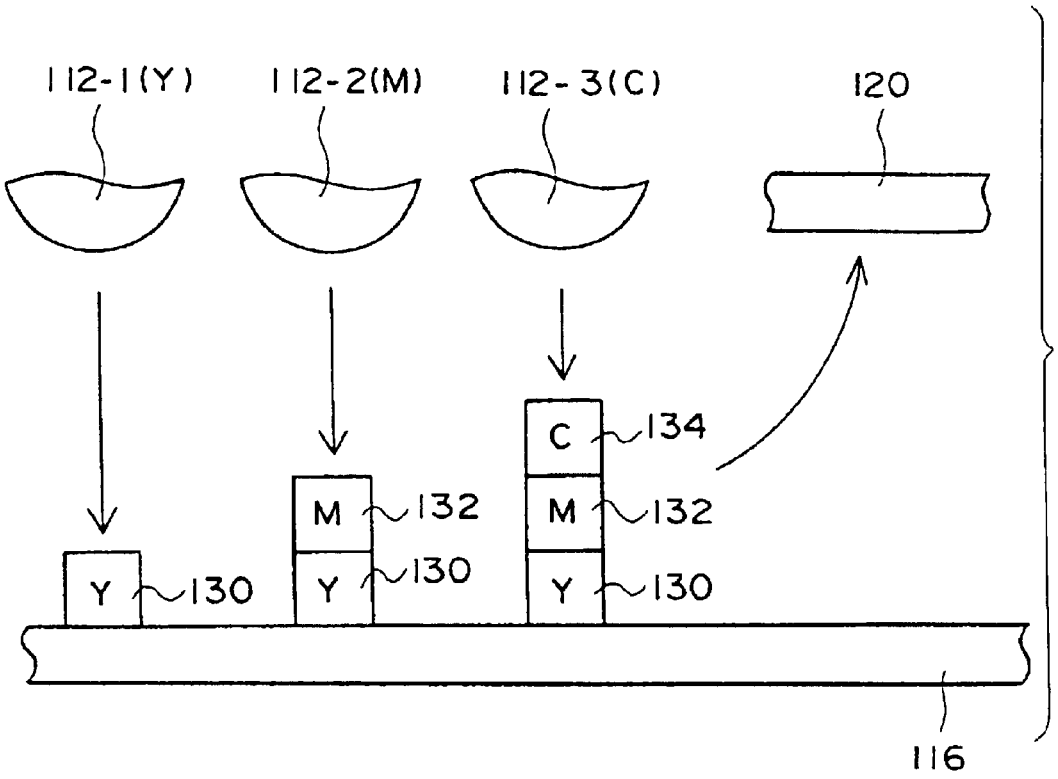
FIG. 21 PRIOR ART
FIG. 21 is a structural view of a conventional intermediate transfer type color image forming device.
Figure 22:
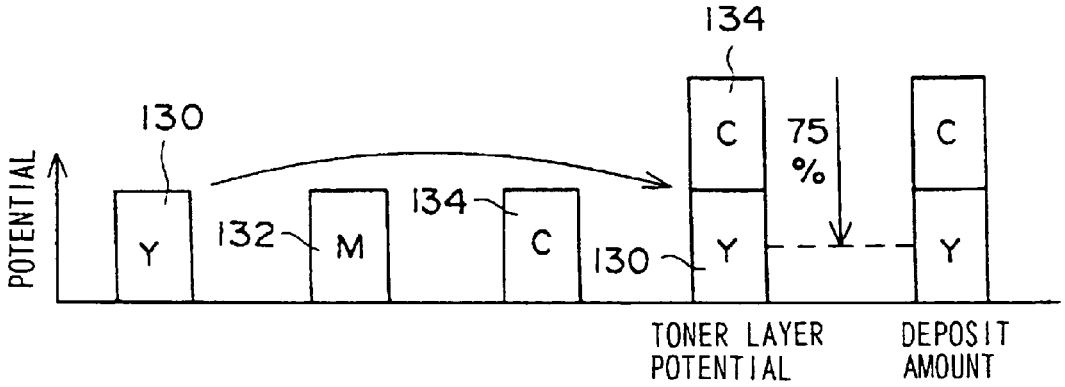
FIG. 22 PRIOR ART
FIG. 22 is an explanatory view of the secondary transfer operation in the conventional color image forming device.

FIG. 20 is a diagram showing the structure of the image forming device of yet another embodiment of the invention and an example in the case where the control method of the charge amount and the deposit amount according to the invention is applied to the conventional four-pass type color electrophotography mechanism.

As shown in FIG. 20, the four-pass type has single photosensitive drum 100 and a developing unit 106 for forming an image of four colors of yellow (Y), magenta (M), cyan (C), and black (K). The photosensitive drum 100 is charged uniformly on its surface by a charger 102 provided subsequently to a cleaning blade 101, and then, an electrostatic latent image is formed by the laser scanning of an exposure unit 104. Next, an image is formed by developing with the yellow toner of the developing unit 106, and the toner image is electrostatically transferred by applying the transfer voltage by a transfer roller 110 onto an intermediate transfer belt 108 in contact with the photosensitive drum 100. Subsequently, the same processing is repeated in the order of magenta, cyan, and black to superpose the colors on the transfer belt 108, and finally, the developer of four colors is transferred onto a sheet at one time by the transfer roller 111, and fixed by a fixing unit 130.

As described above, the four-pass type is advantageous in the cost because only one set of the photosensitive drum 100, the cleaning blade 101, the charger 102, the exposure unit 104, and the transfer roller 110 is required. On the other hand, since the intermediate transfer belt 108 is needed to be rotated four times in order to form a sheet of color image, the speed of color printing is one-fourth times slower than that of black-and-white printing.

To this example, the above described control mechanism of the charge amounts and the deposit amounts of the respective colors by the developing bias power supply 70 in FIG. 2 can also be applied.

In the embodiments described above, the image forming device is described as a page printer, however, the device can be applied to a copy machine, facsimile, and the like. In addition, the intermediate transfer body is not limited to the form of a belt but also the form of a drum can be used, and further, not limited to the single layer, multilayer for function sharing can be utilized.

As above, the invention is described by the examples, however, various changes can be made to the invention within the scope of the technical purpose of the invention, and these are not eliminated from the technical range of the invention.

Industrial Applicability

In an intermediate transfer type color image forming device, toner images of respective colors are formed so that the toner layer potentials transferred onto the intermediate transfer body are lower in the order in which the plural colors are transferred, and the superposition is performed so as to make the potential of the toner layer directly adhered to the transfer body higher and make the potential of the upper toner layer deposited by the superposition lower of the toner layers of the secondary color (two layers) on the intermediate transfer body. Since the potential of the toner layer directly adhered to the intermediate transfer body is higher, the directly adhered toner layer becomes easier to be secondary-transferred, and the secondary transfer efficiency can be improved with the same secondary transfer voltage as conventional. Since the toner layer directly adhered to the intermediate transfer body becomes easier to be secondary-transferred, the reproducibility of the secondary color is improved, and a high quality color image can be formed.

What is claimed is:

1. A color image forming method for forming toner images of a plurality of colors on a medium, the method comprising the steps of:

forming the toner images of the plurality of colors on at least one image bearing body by a plurality of developing units respectively accommodating toner of different colors;

primary transferring the toner images of the plurality of colors onto an intermediate transfer body sequentially for respective colors; and secondary transferring the toner images of the plurality of colors on the intermediate transfer body onto the medium, wherein the toner image forming step includes a step of forming the toner images of the respective colors so that the potentials of toner layers transferred onto the intermediate transfer body are progressively lower in the order in which the plurality of colors are transferred; and wherein the toner image forming step includes a step of forming the toner images of the respective colors so that deposit amounts of the toner transferred onto the intermediate transfer body are progressively lower in the order in which the plurality of colors are transferred.

2. A color image forming method according to claim 1, wherein the toner image forming step includes a step of forming the toner images of the respective colors so that charge amounts of the toner images of the respective colors are progressively lower in the order in which the plurality of colors are transferred.

3. A color image forming method according to claim 2, wherein the toner image forming step includes a step of forming the toner images of the respective colors so that the charge amounts of the toner images of the respective colors are progressively lower in the order in which the plurality of colors are transferred, by varying electrical development conditions of the developing units of the respective colors.

4. A color image forming method according to claim 3, wherein the toner image forming step includes a step of forming the toner images of the respective colors so that the charge amounts of the toner images of the respective colors are progressively lower in the order in which the plurality of colors are transferred, by varying blade bias voltages supplied to blades for restricting toner layer thicknesses on developing rollers of the developing units.

5. A color image forming method according to claim 3, wherein the toner image forming step includes a step of forming the toner images of the respective colors so that the charge amounts of the toner images of the respective colors are progressively lower in the order in which the plurality of colors are transferred, by varying reset bias voltages supplied to reset rollers for supplying toner to developing rollers of the developing units.

6. A color image forming method according to claim 1, wherein the toner image forming step includes a step of forming the toner images of the respective colors so that the deposit amounts of the toner images of the respective colors are progressively lower in the order in which the plurality of colors are transferred, by varying electrical development conditions 6 the developing units of the respective colors.

7. A color image forming method according to claim 6, wherein the toner image forming step includes a step of forming the toner images of the respective colors so that the deposit amounts of the toner images of the respective colors are progressively lower in the order in which the plurality of colors are transferred, by varying blade bias voltages supplied to blades for restricting toner layer thicknesses on developing rollers of the developing units.

8. A color image forming method according to claim 6, wherein the toner image forming step includes a step of forming the toner images of the respective colors so that the deposit amounts of the toner images of the respective colors are progressively lower in the order in which the plurality of colors are transferred, by varying reset bias voltages supplied to reset rollers for supplying toner to developing rollers of the developing units.

9. A color image forming method according to claim 6, wherein the toner image forming step includes a step of forming the toner images of the respective colors so that the deposit amounts of the toner images of the respective colors are progressively lower in the order in which the plurality of colors are transferred, by varying developing bias voltages supplied to developing rollers of the developing units.

10. A color image forming method according to claim 1, wherein the toner image forming step includes a step of forming the toner images of the respective colors of the plurality of colors by the plurality of developing units accommodating toner of corresponding colors, on a plurality of image bearing bodies respectively corresponding to the plurality of colors.

11. A color image forming device for forming toner images of a plurality of colors on a medium, the device comprising:

image forming units for forming the-toner images of the plurality of colors on at least one image bearing body by a plurality of developing units respectively accommodating toner of different colors;

an intermediate transfer body;

primary transfer means for primary transferring the toner images of the plurality of colors onto the intermediate transfer body sequentially for respective colors; and secondary transfer means for secondary transferring the toner images of the plurality of colors on the intermediate transfer body onto the medium, wherein the image forming units form the toner images of the respective colors so that potentials of toner layers transferred onto the intermediate transfer body are progressively lower in the order in which the plurality of colors are transferred; and wherein the image forming units form the toner images of the respective colors so that deposit amounts of the toner transferred onto the intermediate transfer body are progressively lower in the order in which the plurality of colors are transferred.

12. A color image forming device according to claim 11, wherein the image forming units form the toner images of the respective colors so that charge amounts of the toner images of the respective colors are progressively lower in the order in which the plurality of colors are transferred.

13. A color image forming device according to claim 12, wherein the image forming units form the toner images of the respective colors so that the charge amounts of the toner images of the respective colors are progressively lower in the order in which the plurality of colors are transferred, by varying electrical development conditions of the developing units of the respective colors.

14. A color image forming device according to claim 13, wherein the image forming units form the toner images of the respective colors so that the charge amounts of the toner of the respective colors are progressively lower in the order in which the plurality of colors are transferred, by varying blade bias voltages supplied to blades for restricting toner layer thicknesses on developing rollers of the developing units.

15. A color image forming device according to claim 13, wherein the image forming units form the toner images of the respective colors so that the charge amounts of the toner images of the respective colors are progressively lower in the order in which the plurality of colors are transferred, by varying reset bias voltages supplied to reset rollers for supplying toner to developing rollers of the developing units.

16. A color image forming device according to claim 12, wherein the image forming units form the toner images of the respective colors so that the deposit amounts of the toner images of the respective colors are progressively lower in the order in which the plurality of colors are transferred, by varying electrical development conditions of the developing units of the respective colors.

17. A color image forming device according to claim 16, wherein the image forming units form the toner images of the respective colors so that the deposit amounts of the toner images of the respective colors are progressively lower in the order in which the plurality of colors are transferred, by varying blade bias voltages supplied to blades for restricting toner layer thicknesses of developing rollers on the developing units.

18. A color image forming device according to claim 16, wherein the image forming units form the toner images of the respective colors so that the deposit amounts of the toner images of the respective colors are progressively lower in the order in which the plurality of colors are transferred, by varying reset bias voltages supplied to reset rollers for supplying toner to developing rollers of the developing units.

19. A color image forming device according to claim 16, wherein the image forming units form the toner images of the respective colors so that the deposit amounts of the toner images of the respective colors are progressively lower in the order in which the plurality of colors are transferred, by varying developing bias voltages supplied to developing rollers of the developing units.

20. A color image forming device according to claim 11, wherein the image forming units include units for forming the toner images respectively having different colors on a plurality of image bearing bodies, and the primary transfer means applies transfer voltages to the intermediate body and includes a plurality of primary transfer units for transferring the toner images on the plurality of image bearing bodies onto the intermediate transfer body.

* * * * *